US010286990B2

(12) United States Patent
Hasegawa et al.

(10) Patent No.: US 10,286,990 B2
(45) Date of Patent: May 14, 2019

(54) OUTBOARD MOTOR AND SEALING STRUCTURE FOR DIVISIBLE ENGINE COVER USED THEREFOR

(71) Applicant: YAMAHA HATSUDOKI KABUSHIKI KAISHA, Iwata-shi, Shizuoka (JP)

(72) Inventors: Hiroyuki Hasegawa, Shizuoka (JP); Kyoji Oishi, Hiroshima (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/964,137

(22) Filed: Apr. 27, 2018

(65) Prior Publication Data

US 2018/0327067 A1 Nov. 15, 2018

(30) Foreign Application Priority Data

May 12, 2017 (JP) ..... 2017-095809

(51) Int. Cl.

| | |
|---|---|
| ***B63H 20/32*** | (2006.01) |
| ***B63H 21/36*** | (2006.01) |
| ***F02M 35/16*** | (2006.01) |
| ***F02B 61/04*** | (2006.01) |
| *B63H 20/24* | (2006.01) |

(52) U.S. Cl.

CPC ..... *B63H 20/32* (2013.01); *F02B 61/045* (2013.01); *F02M 35/168* (2013.01); *B63H 20/245* (2013.01); *B63H 2020/323* (2013.01)

(58) Field of Classification Search

CPC .. B63H 20/245; B63H 20/32; B63H 2020/32; B63H 20/323; F02B 61/045; F02M 35/168

USPC ..... 440/76, 77

See application file for complete search history.

(56) References Cited

U.S. PATENT DOCUMENTS

| | | | | | |
|---|---|---|---|---|---|
| 4,348,194 | A | * | 9/1982 | Walsh | F02B 61/045 123/195 P |
| 4,723,927 | A | * | 2/1988 | Walsh | F02B 61/045 181/229 |
| 4,800,854 | A | * | 1/1989 | Boda | B63H 20/32 123/195 P |
| 5,069,643 | A | | 12/1991 | Westberg et al. | |
| 5,360,358 | A | * | 11/1994 | Haman | B63H 20/32 123/195 P |
| 5,487,687 | A | * | 1/1996 | Idzikowski | F02B 61/045 440/77 |

(Continued)

FOREIGN PATENT DOCUMENTS

JP 06-234393 A 8/1994

*Primary Examiner* — Daniel V Venne

(74) *Attorney, Agent, or Firm* — Keating and Bennett, LLP

(57) ABSTRACT

An outboard motor includes a mount on which an engine is mounted, an engine cover, and a sealing structure. The engine cover is divisible into a top portion, a front bottom portion, and a side bottom portion. A first seal in the sealing structure integrally includes a first portion, a second portion, and a third portion. The first portion seals the boundary between the top portion, the front bottom portion, and the side bottom portion. The second portion seals the boundary between the front bottom portion, the mount, and the side bottom portion. The third portion seals the boundary between the front bottom portion and the side bottom portion.

20 Claims, 17 Drawing Sheets

(56) References Cited

U.S. PATENT DOCUMENTS

| | | | | |
|---|---|---|---|---|
| 5,921,827 | A * | 7/1999 | Ichihashi | F02B 61/045 123/195 P |
| 6,663,450 | B1 * | 12/2003 | Walczak | F02B 61/045 123/195 P |
| 6,669,517 | B1 * | 12/2003 | Alby | F02B 61/045 123/195 P |
| 7,621,791 | B2 * | 11/2009 | Yazaki | F02F 7/0082 440/77 |

* cited by examiner

OUTBOARD MOTOR AND SEALING STRUCTURE FOR DIVISIBLE ENGINE COVER USED THEREFOR

CROSS REFERENCE TO RELATED APPLICATIONS

This application claims the benefit of priority to Japanese Patent Application No. 2017-095809 filed on May 12, 2017. The entire contents of this application are hereby incorporated herein by reference.

BACKGROUND OF THE INVENTION

1. Field of the Invention

The present invention relates to an outboard motor and a sealing structure for a divisible engine cover used therefor.

2. Description of the Related Art

The outboard motor described in Japanese Unexamined Patent Application Publication No. H6-234393 includes a motor cowl covering an engine, the motor cowl being divisible into an upper motor cover and a lower motor cover. The boundary between the lower end of the upper motor cover and the upper end of the lower motor cover is sealed with a cover seal that is annular in plan view. The lower motor cover is divisible into a first cover portion and a second cover portion.

The motor cowl described in Japanese Unexamined Patent Application Publication No. H6-234393 has a boundary spanning three parts of the upper motor cover, the first cover portion, and the second cover portion and another boundary continuous with the boundary and existing between the two parts of the first cover portion and the second cover portion. With just the annular, i.e., simply shaped, cover seal disclosed in Japanese Unexamined Patent Application Publication No. H6-234393, it is difficult to seal these boundaries without leakage, and external water may leak through the boundaries and enter into the engine cover. When the water within the engine cover enters into the engine, a problem may occur with the engine.

SUMMARY OF THE INVENTION

In order to overcome the previously unrecognized and unsolved challenges described above, a preferred embodiment of the present invention provides an outboard motor including an engine, an engine cover including at least a first cover, a second cover, and a third cover that cover the engine, and a seal. The engine cover includes a first boundary spanning three portions of the first cover, the second cover, and the third cover and a second boundary between two of the three portions and continuous with the first boundary. The seal integrally includes a three-part seal that seals the first boundary and a two-part seal with a structure different from that of the three-part seal and that seals the second boundary.

In accordance with the preferred embodiment described above, the engine cover is divisible into at least the first cover, the second cover, and the third cover, has the first boundary spanning three portions of the three covers and the second boundary between two of the three portions and continuous with the first boundary. The seal integrally includes the three-part seal and the two-part seal, which seal the first boundary and the second boundary and have respective different structures. The seal seals the first boundary and the second boundary with the three-part seal sealing the first boundary and the two-part seal sealing the second boundary. This significantly reduces or prevents external water from leaking through the first boundary and the second boundary, which are boundaries between the covers of the divisible engine cover, and entering into the engine.

In a preferred embodiment of the present invention, the three-part seal may be a molded article and the two-part seal may be an extrusion molded article.

In accordance with the preferred embodiment described above, a clearance gap in the complex shaped first boundary spanning the three portions is filled with the molded three-part seal and a clearance gap in the second boundary spanning the two portions is filled with the extrusion molded two-part seal. This allows the seal to seal the first boundary and the second boundary.

A preferred embodiment of the present invention provides an outboard motor including an engine, a mount on which the engine is mounted, an engine cover, and a sealing structure for the engine cover. The engine cover includes a top portion opposing the engine from above, a front bottom portion opposing the engine from the front, and a side bottom portion opposing the engine from the side. The front bottom portion is located at a position lower than a position of the top portion, and the side bottom portion is located at a position lower than the position of the top portion and rearward of the front bottom portion. The engine cover is coupled to the mount through the front bottom portion and the side bottom portion. The sealing structure includes a first seal. The first seal integrally includes a first portion, a second portion, and a third portion extending from the first portion to the second portion. The first portion seals the boundary between the top portion, the front bottom portion, and the side bottom portion. The second portion seals the boundary between the front bottom portion, the mount, and the side bottom portion. The third portion seals the boundary between the front bottom portion and the side bottom portion.

In accordance with the preferred embodiment described above, an engine cover, which is divisible into three or more covers including at least the top portion, the front bottom portion, and the side bottom portion, includes a boundary between the top portion, the front bottom portion, and the side bottom portion and a boundary between the front bottom portion, the mount, and the side bottom portion. The first seal of the sealing structure seals the boundary between the top portion, the front bottom portion, and the side bottom portion with the first portion; seals the boundary between the front bottom portion, the mount, and the side bottom portion with the second portion; and seals the other boundary extending between these boundaries with the third portion. This structure provides desirable sealing characteristics for a divisible engine cover having such a complex structure. This significantly reduces or prevents external water from leaking through the boundaries between the multiple covers of the divisible engine cover and entering into the engine.

In a preferred embodiment of the present invention, the first portion may be located at a position higher than a position of the second portion, and an upper end of the front bottom portion may include an opposing portion that opposes an upper end of the side bottom portion from within the engine cover. In this case, the first portion integrally includes an inner portion and an outer portion. The inner portion is at least partially located between the opposing portion and the upper end of the side bottom portion. The outer portion extends through the boundary between the outer surface of the upper end of the front bottom portion and the outer surface of the upper end of the side bottom portion so as to be located on the outer surface of the upper end of the front bottom portion. The inner portion includes a water storage groove adjacent to the outer portion and opposing the side bottom portion.

In accordance with the preferred embodiment described above, the first portion seals the boundary between the opposing portion in the upper end of the front bottom portion and the upper end of the side bottom portion with the inner portion and seals the boundary between the outer surface of the upper end of the front bottom portion and the outer surface of the upper end of the side bottom portion with the outer portion. This structure provides desirable sealing characteristics at the boundary between the upper end of the front bottom portion and the upper end of the side bottom portion. This significantly reduces or prevents external water from leaking through the boundary between the upper end of the side bottom portion and the upper end of the front bottom portion and entering into the engine.

Even if external water leaks through the boundary between the outer surface of the upper end of the front bottom portion and the outer surface of the upper end of the side bottom portion and enters into the engine cover, the water is immediately contained in the water storage groove in the inner portion so that it is difficult to reach the engine. This further significantly reduces or prevents water from entering into the engine.

In a preferred embodiment of the present invention, the inner portion may include an upper rib protruding toward the upper end of the side bottom portion and extending rearward from the upper end of the water storage groove.

In accordance with the preferred embodiment described above, water within the water storage groove will be blocked by the upper rib from scattering upward within the engine cover to reach the engine, which further significantly reduces or prevents water from entering into the engine.

In a preferred embodiment of the present invention, a drainage hole may be provided in a lower portion of the engine cover or the mount, and the inner portion may include a guide extending rearward from the lower end of the water storage groove to guide water within the water storage groove to the drainage hole.

In accordance with the preferred embodiment described above, water within the water storage groove is guided through the guide to the drainage hole and discharged out of the engine cover, which further significantly reduces or prevents water from entering into the engine.

In a preferred embodiment of the present invention, an insertion hole, through which a fastening member coupling the opposing portion and the side bottom portion is inserted, may be provided in a penetrating manner in a portion of the inner portion located between the upper rib and the guide.

In accordance with the preferred embodiment described above, even if external water reaches the insertion hole, the water is blocked by the upper rib from scattering upward to reach the engine and also is guided through the guide to the drainage hole to be discharged out of the engine cover. This further significantly reduces or prevents water from entering into the engine.

In a preferred embodiment of the present invention, the sealing structure may further include a second seal that seals the boundary between the top portion and the front bottom portion and the boundary between the top portion and the side bottom portion. In this case, the second seal may surround a portion of the outer portion located between the second seal and the front bottom portion.

In accordance with the preferred embodiment described above, the second seal provides desirable sealing characteristics at the boundary between the top portion and the front bottom portion and the boundary between the top portion and the side bottom portion. This significantly reduces or prevents external water from leaking through these boundaries and entering into the engine.

Further, the second seal surrounds a portion of the outer portion, which seals the boundary between the outer surface of the upper end of the front bottom portion and the outer surface of the upper end of the side bottom portion in the first seal, between the second seal and the front bottom portion. This causes the first seal and the second seal to be continuous with each other. Since the boundary between the top portion, the front bottom portion, and the side bottom portion is thus sealed by both the first seal and the second seal, this structure provides desirable sealing characteristics at the boundary. This significantly reduces or prevents external water from leaking through the boundary and entering into the engine.

In a preferred embodiment of the present invention, the sealing structure may further include a third seal that seals the boundary between the mount and the front bottom portion and the boundary between the mount and the side bottom portion. In this case, the second portion includes a sealing surface that adheres to the third seal from the front at the boundary between the front bottom portion, the mount, and the side bottom portion.

In accordance with the preferred embodiment described above, the third seal provides desirable sealing characteristics at the boundary between the mount and the front bottom portion and the boundary between the mount and the side bottom portion. This significantly reduces or prevents external water from leaking through these boundaries and entering into the engine.

Further, in the first seal, the sealing surface of the second portion adheres tightly to the third seal from the front at the boundary between the front bottom portion, the mount, and the side bottom portion to seal the boundary. This causes the first seal and the third seal to be continuous with each other. Since the boundary is thus sealed by both the first seal and the third seal, desirable sealing characteristics at the boundary are achieved. This significantly reduces or prevents external water from leaking through the boundary and entering into the engine.

In a preferred embodiment of the present invention, a longitudinally extending positioning groove may be provided in the second portion, and the front bottom portion may include a positioning portion fitted into the positioning groove.

In accordance with the preferred embodiment described above, the second portion is preferably positioned laterally to seal the boundary between the front bottom portion, the mount, and the side bottom portion with the lateral position being stabilized. This structure provides desirable sealing characteristics at the boundary and significantly reduces or prevents external water from leaking through the boundary and entering into the engine.

In a preferred embodiment of the present invention, the first portion and the second portion may be molded articles and the third portion may be an extrusion molded article.

In accordance with the preferred embodiment described above, it is possible to achieve a structure in which the first seal integrally includes the first portion, the second portion, and the third portion.

In a preferred embodiment of the present invention, the engine cover may be divisible into the top portion, the front bottom portion, and a pair of the left and right side bottom portions opposing the engine, respectively, from the left and the right. In this case, the sealing structure includes a pair of the left and right first seals. The sealing structure may further include a fourth seal that seals the boundary between the pair of side bottom portions.

In accordance with the preferred embodiment described above, the divisible engine cover has a more complex structure due to it being divided into four or more covers of the top portion, the front bottom portion, and the pair of left and right side bottom portions. The pair of left and right first seals correspond to the pair of left and right side bottom portions.

The left first seal seals the boundary between the top portion, the front bottom portion, and the left side bottom portion with the first portion and seals the boundary between the front bottom portion, the mount, and the left side bottom portion with the second portion. The left first seal seals the other boundary extending between these boundaries with the third portion.

The right first seal seals the boundary between the top portion, the front bottom portion, and the right side bottom portion with the first portion and seals the boundary between the front bottom portion, the mount, and the right side bottom portion with the second portion. The right first seal seals the other boundary extending between these boundaries with the third portion.

Further, the fourth seal seals the boundary between the pair of side bottom portions.

As described heretofore, it is possible to provide desirable sealing characteristics for a divisible engine cover having such a complex structure. This significantly reduces or prevents external water from leaking through the boundaries between the multiple covers of the divisible engine cover and entering into the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
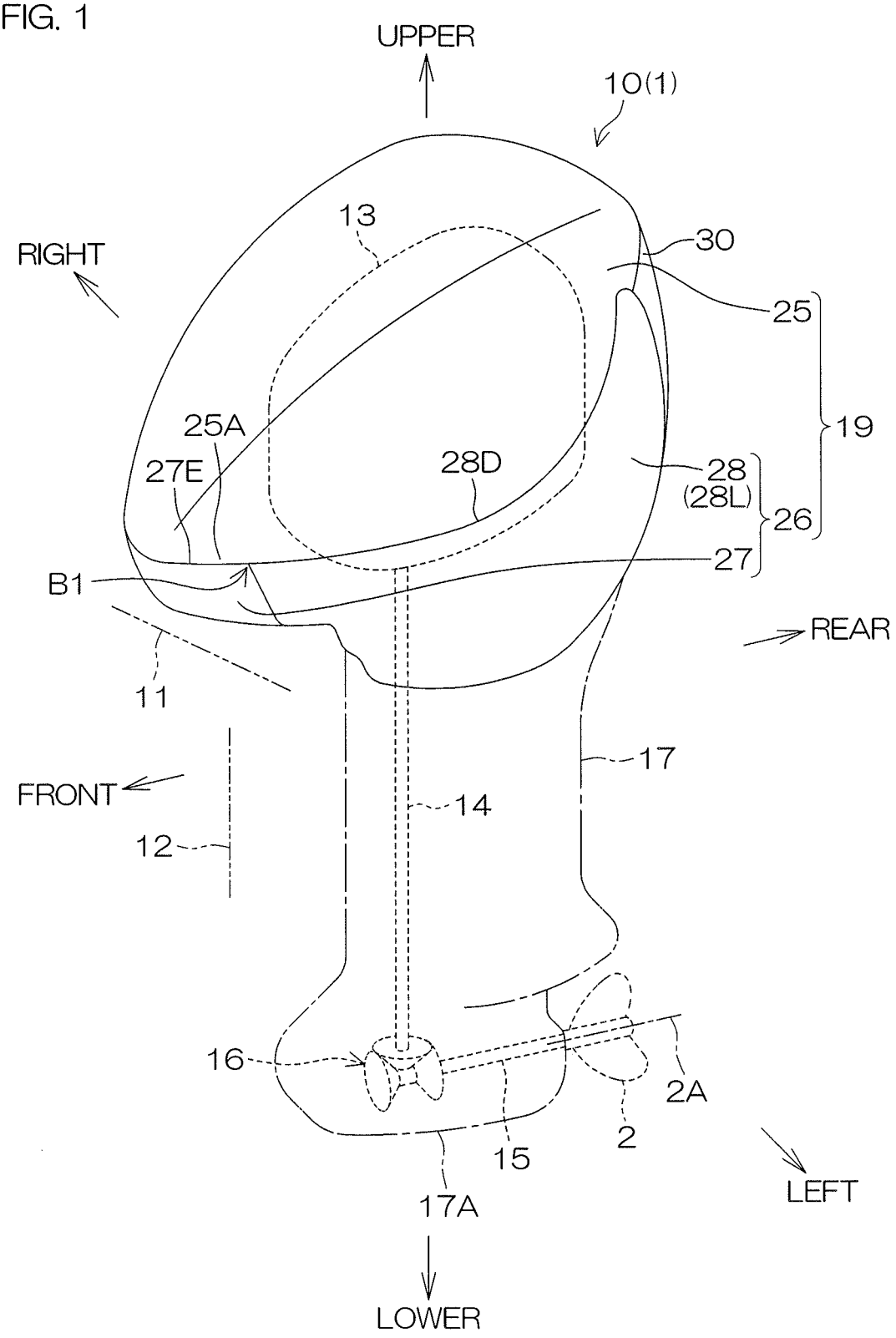
FIG. 1 is a schematic perspective view of an outboard motor according to a preferred embodiment of the present invention.

Preferred embodiments of the present invention will hereinafter be described in detail with reference to the accompanying drawings. FIG. 1 is a schematic front perspective view of an outboard motor 1 according to a preferred embodiment of the present invention. The outboard motor 1 shown in FIG. 1 is in a basic posture. In the basic posture, the rotation axis 2A of a propeller 2 in the outboard motor 1 extends both horizontally and in a front to back direction. The front to back direction, the lateral direction, and the vertical direction in the following description correspond, respectively, to the front to back direction, the lateral direction, and the vertical direction when the outboard motor 1 is in the basic posture.

The outboard motor 1 includes an outboard motor main body 10 and an installation mechanism (not shown) arranged to install the outboard motor main body 10 on a hull (not shown). Supported by the installation mechanism, the outboard motor main body 10 is turned vertically about a laterally extending horizontal axis 11 and also turned laterally about a vertically extending vertical axis 12. The outboard motor main body 10 includes the propeller 2, an engine 13, a drive shaft 14, a propeller shaft 15, a gear mechanism 16, a casing 17, a mount 18 (see FIG. 2 below), and an engine cover 19.

The engine 13 is, for example, an internal combustion engine or an electric motor. In this preferred embodiment, the engine 13 is preferably an internal combustion engine with a crankshaft (not shown) incorporated therein arranged to rotate about a vertically extending crank axis. The drive shaft 14 is coupled to a lower end of the crankshaft (not shown) of the engine 13 and extends downward.

The propeller shaft 15 extends in in a front to back direction at a position lower than that of the lower end of the drive shaft 14. The gear mechanism 16 couples the lower end of the drive shaft 14 and a front end of the propeller shaft 15. The propeller 2 is attached to a rear end of the propeller shaft 15. The rotation of the drive shaft 14 with the driving of the engine 13 is transmitted by the gear mechanism 16 to the propeller shaft 15. This allows the propeller 2 to be driven and rotated by the engine 13. The rotation axis 2A of the propeller 2 coincides with the central axis of the propeller shaft 15. The rotation of the propeller 2 generates a propulsive force for forward or rearward movement of the hull.

The casing 17 is a vertically extending hollow body housing the drive shaft 14, the propeller shaft 15, and the gear mechanism 16 therein. The propeller shaft 15 and the gear mechanism 16 are housed in a lower case 17A that is a lower end of the casing 17. The propeller 2 is located outside the lower case 17A.

Figure 2:
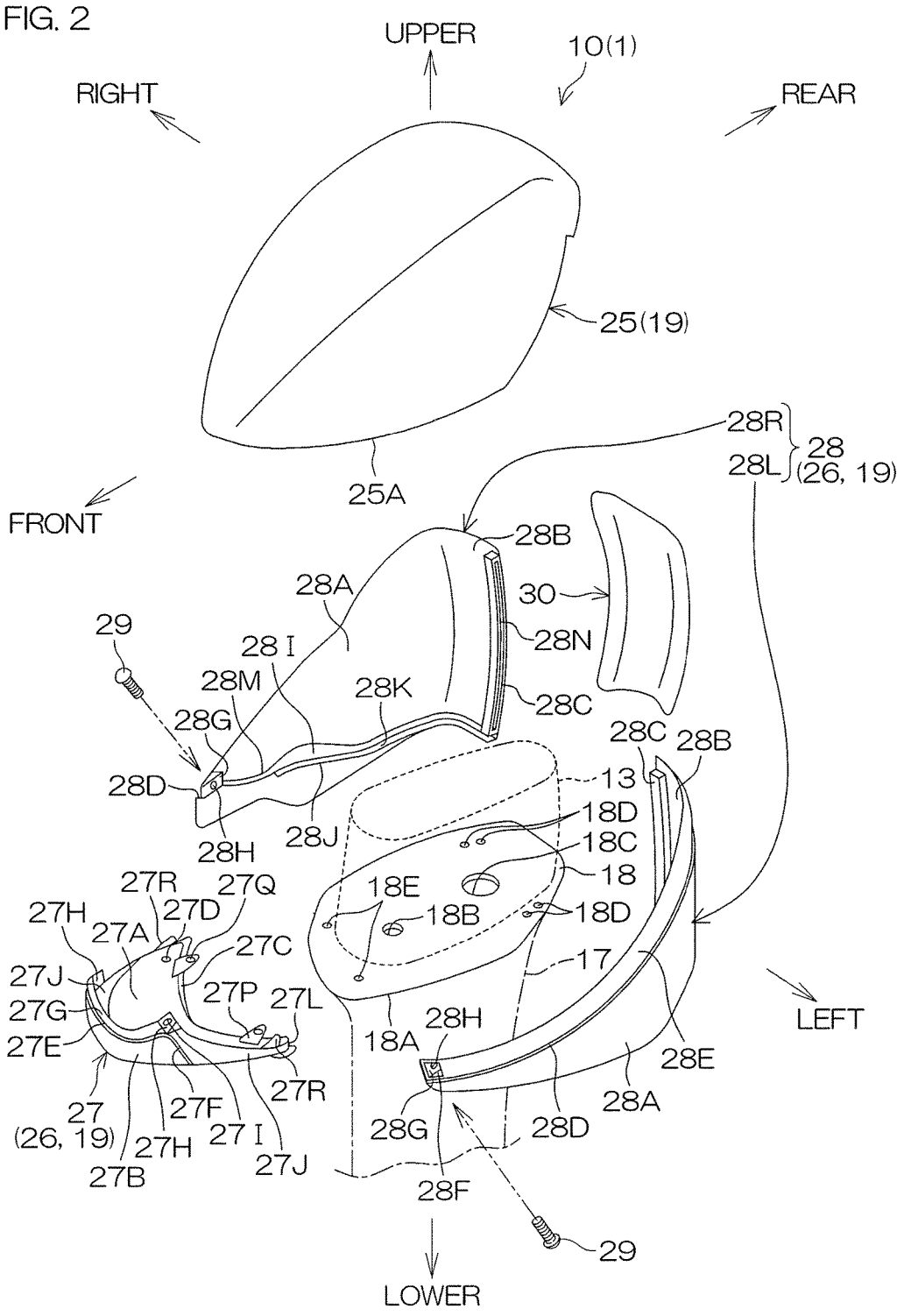
FIG. 2 is a schematic exploded perspective view of an upper portion of an outboard motor main body in the outboard motor.

FIG. 2 is a schematic exploded perspective view of an upper portion of the outboard motor main body 10. The mount 18 is a so-called exhaust guide preferably made of metal such as aluminum and having a plate shape. The mount 18 is installed in an upper end of the casing 17 in a manner closing the interior space of the casing 17 from above. The upper surface of the mount 18 preferably has a rectangular or substantially rectangular shape elongated in the front to back direction. The engine 13 is mounted on the upper surface of the mount 18. The outer edge 18A of the upper surface of the mount 18 defines the outline of the mount 18 in plan view and protrudes outwardly from the engine 13 around the entire circumference.

An insertion hole 18B, an exhaust hole 18C located, for example, rearward of the insertion hole 18B, and two drainage holes 18D located, for example, on each of the left and right sides of the exhaust hole 18C are provided in the upper surface of the mount 18. The insertion hole 18B, the exhaust hole 18C, and the drainage holes 18D penetrate through the mount 18 vertically. The drive shaft 14 is inserted through the insertion hole 18B. Exhaust gas from the engine 13 is discharged through the exhaust hole 18C and the interior of the casing 17 out of the outboard motor main body 10. Water, if on the upper surface of the mount 18, falls through the drainage holes 18D and the interior of the casing 17 to be discharged out of the outboard motor main body 10. It is noted that the mount 18 may include a portion of a flow path for cooling water that cools the engine 13 or lubricant that lubricates the engine 13.

The engine cover 19 preferably has a box shape and is located at a position higher than that of the casing 17 to cover the engine 13 (see FIG. 1). The engine cover 19 is vertically divisible into a top portion 25 exemplifying a first cover and a bottom portion 26. The bottom portion 26 defining a lower portion of the engine cover 19 is divisible into at least a front bottom portion 27 exemplifying a second cover and a side bottom portion 28 exemplifying a third cover.

The top portion 25 is made of, for example, resin and preferably has a box shape. The top portion 25 includes an opening (not shown) that opens the interior space thereof downward. In this preferred embodiment, the resin is preferably, for example, a thermosetting resin. The lower edge 25A of the top portion 25 has a continuous annular shape to define the opening.

The front bottom portion 27 is made of, for example, metal such as aluminum and integrally includes a horizontal portion 27A and a vertical portion 27B. The horizontal portion 27A preferably has a plate shape with its thickness direction coinciding or substantially coinciding with the vertical direction. The horizontal portion 27A preferably has a semicircular or substantially semicircular shape in plan view. The front edge of the horizontal portion 27A is thus curved in an arcuate shape bulging forward. The rear edge of the horizontal portion 27A is also curved in an arcuate shape bulging forward. The rear edge of the horizontal portion 27A includes a fitting groove 27C extending in a curved manner along the rear edge. The fitting groove 27C is recessed forward and opens rearward. At positions adjacent to the fitting groove 27C in lateral ends of the horizontal portion 27A, drainage holes 27D are provided in a manner vertically penetrating through the horizontal portion 27A.

The vertical portion 27B preferably has a plate shape curved along the front edge of the horizontal portion 27A and extending upward. The front surface of the vertical portion 27B defines a portion of the outer surface of the engine cover 19. In an upper end of the front surface of the vertical portion 27B, there is a horizontal step 27E extending laterally in a curved manner and a pair of left and right vertical steps 27F extending downward from the lateral ends of the horizontal step 27E. The portion of the vertical portion 27B higher than the horizontal step 27E includes an upper end 27G of the front bottom portion 27. The front surface of the upper end 27G is offset rearward by one step from the portion of the front surface of the vertical portion 27B surrounded by the horizontal step 27E and the pair of vertical steps 27F. Opposing portions 27H are provided integrally at the respective lateral ends of the upper end 27G. A screw hole 27I is provided in the left surface of the left opposing portion 27H. A screw hole 27I is also provided in the right surface of the right opposing portion 27H. The portion of the vertical portion 27B rearward of each vertical step 27F will be referred to as a rear portion 27J. The upper end edge of the rear portion 27J is inclined so as to descend as it extends rearward.

The side bottom portion 28 is made of, for example, resin and includes a pair of left and right portions. Of the pair of left and right side bottom portions 28, the left side bottom portion 28 will be referred to as a side bottom portion 28L, while the right side bottom portion 28 will be referred to as a side bottom portion 28R. The side bottom portion 28L and the side bottom portion 28R are preferably laterally symmetric. Each side bottom portion 28 integrally includes a plate-shaped main body 28A extending in a front to back and vertical direction and an extended portion 28B extending in a manner bent from the rear end of the main body 28A toward the other side bottom portion 28. The pair of side bottom portions 28 are coupled through a right end of the extended portion 28B of the side bottom portion 28L and a left end of the extended portion 28B of the side bottom portion 28R. The right end of the extended portion 28B of the side bottom portion 28L and the left end of the extended portion 28B of the side bottom portion 28R will each be referred to as a coupling 28C.

In the side bottom portion 28L, the left surface of the main body 28A and the rear surface of the extended portion 28B defines the outer surface of the side bottom portion 28L and a portion of the outer surface of the engine cover 19. In the side bottom portion 28L, the right surface of the main body 28A and the front surface of the extended portion 28B define the inner surface of the side bottom portion 28L and a portion of the inner surface of the engine cover 19. In the side bottom portion 28R, the right surface of the main body 28A and the rear surface of the extended portion 28B define the outer surface of the side bottom portion 28R and a portion of the outer surface of the engine cover 19. In the side bottom portion 28R, the left surface of the main body 28A and the front surface of the extended portion 28B define the inner surface of the side bottom portion 28R and a portion of the inner surface of the engine cover 19.

In an upper end of the outer surface of each side bottom portion 28, a step 28D extends from the front end of the main body 28A to the coupling 28C. The portion of each side bottom portion 28 higher than the step 28D is an upper end 28E of the side bottom portion 28. The outer surface of the upper end 28E is offset by one step inside the engine cover 19 farther than the portion of the outer surface of the side bottom portion 28 lower than the step 28D. In a front end of the upper end 28E, a recess 28F is recessed inward of the engine cover 19. A bottom portion 28G of the recess 28F is raised in a convex shape on the inner surface of the side bottom portion 28. The bottom portion 28G is provided with an insertion hole 28H penetrating laterally through the bottom portion 28G.

On the inner surface of each side bottom portion 28, there is integrally provided an upper rib 28I protruding inward of the engine cover 19 and extending from the lower end of the bottom portion 28G of the recess 28F to the lower end of the coupling 28C. On the inner surface of each side bottom portion 28, there is integrally provided a lower rib 28J extending from a location rearward of the bottom portion 28G to the lower end of the coupling 28C. The lower rib 28J is located below a portion of the upper rib 28I and extends parallel or substantially parallel with the upper rib 28I to the lower end of the coupling 28C. A fitting groove 28K is provided between the upper rib 28I and the lower rib 28J. The fitting groove 28K extends from a position rearward of the bottom portion 28G to the lower end of the coupling 28C. The portion of the upper rib 28I located forward of the fitting groove 28K and extending to the lower end of the recess 28F will be referred to as an extended section 28M. The lower rib 28J does not exist below the extended section 28M.

Assembly of the divisible engine cover 19 will be described with reference also to FIG. 1. First, an operator brings the front bottom portion 27 closer to the mount 18 and fits the front portion of the outer edge 18A of the mount 18 into the fitting groove 27C in the horizontal portion 27A of the front bottom portion 27 from behind. This causes the front bottom portion 27 to be coupled to the mount 18. It is noted that the rear edge of the horizontal portion 27A is provided with a fixed portion 27P protruding rearward to overlap the front end of the mount 18 from above. A fastening member (not shown) such as a bolt is assembled into a screw hole 18E in the front end of the mount 18 through an insertion hole 27Q defined in the fixed portion 27P such that the mount 18 and the front bottom portion 27 are fixed to each other.

Next, the operator arranges the pair of side bottom portions 28 at a position rearward of the front bottom portion 27 and sandwiches the mount 18 bilaterally with the side bottom portions 28 until the couplings 28C are coupled to each other. Then, the left portion of the outer edge 18A of the mount 18 fits into the fitting groove 28K (not shown) in the side bottom portion 28L from the right, while the right portion of the outer edge 18A fits into the fitting groove 28K in the side bottom portion 28R from the left. This causes the side bottom portions 28 to be coupled to the mount 18. It is noted that the side bottom portions 28 and the mount 18 may be fixed using a fastening member such as a bolt if needed.

The front portion of the main body 28A of the side bottom portion 28L covers the left rear portion 27J of the vertical portion 27B of the front bottom portion 27 from the left. The front portion of the main body 28A of the side bottom portion 28R covers the right rear portion 27J of the main body 28A from the right. In this state, the left and right opposing portions 27H in the upper end 27G of the front bottom portion 27 are opposed from within the engine cover 19 to the bottom portions 28G of the recesses 28F in the upper ends 28E of the side bottom portions 28 located at laterally corresponding positions. In addition, the insertion holes 28H in the bottom portions 28G and the screw holes 27I in the opposing portions 27H are aligned with each other. When the operator assembles coupling members 29 such as bolts through the insertion holes 28H into the screw holes 27I, the opposing portions 27H and the side bottom portions 28 are coupled. This causes the front bottom portion 27 and the side bottom portions 28 to be fixed to each other.

With the pair of side bottom portions 28 being coupled to the front bottom portion 27, the horizontal step 27E of the vertical portion 27B of the front bottom portion 27 and the steps 28D of the side bottom portions 28 are connected to define one annular body (see FIG. 1). The outer surface of the upper end 27G of the front bottom portion 27 and the outer surfaces of the upper ends 28E of the side bottom portions 28 are also connected to define one annular body. The fitting groove 27C in the horizontal portion 27A of the front bottom portion 27 and the fitting grooves 28K in the side bottom portions 28 are also connected to define one annular body. The upper end edges of the left and right rear portions 27J of the vertical portion 27B are opposed from below to the extended sections 28M of the side bottom portions 28 located at laterally corresponding positions.

The operator then covers the engine 13 with the top portion 25. The lower edge 25A of the top portion 25 then encompasses the annular body defined by the upper end 27G of the front bottom portion 27 and the upper ends 28E of the side bottom portions 28. This causes the top portion 25 to be coupled to the front bottom portion 27 and the side bottom portions 28. It is noted that the top portion 25 may be fixed to the front bottom portion 27 and the side bottom portions 28 using a fastening member such as a bolt if needed.

The assembling of the engine cover 19 and the coupling of the engine cover 19 to the mount 18 are thus completed. In the completed engine cover 19, the front bottom portion 27 is located at a position lower than that of the top portion 25 and the pair of side bottom portions 28 are located at a position lower than that of the top portion 25 and rearward of the front bottom portion 27 (see FIG. 1). The engine 13 mounted on the mount 18 is opposed at least upward to the top portion 25 and opposed forward to at least the vertical portion 27B of the front bottom portion 27. The engine 13 is also opposed sideward, that is, leftward and rightward to at least the main body portions 28A and opposed rearward to at least the extended portions 28B of the pair of side bottom portions 28. The engine cover 19 may further include a rear panel 30 that covers the extended portions 28B of the pair of side bottom portions 28 from behind.

Figure 3:
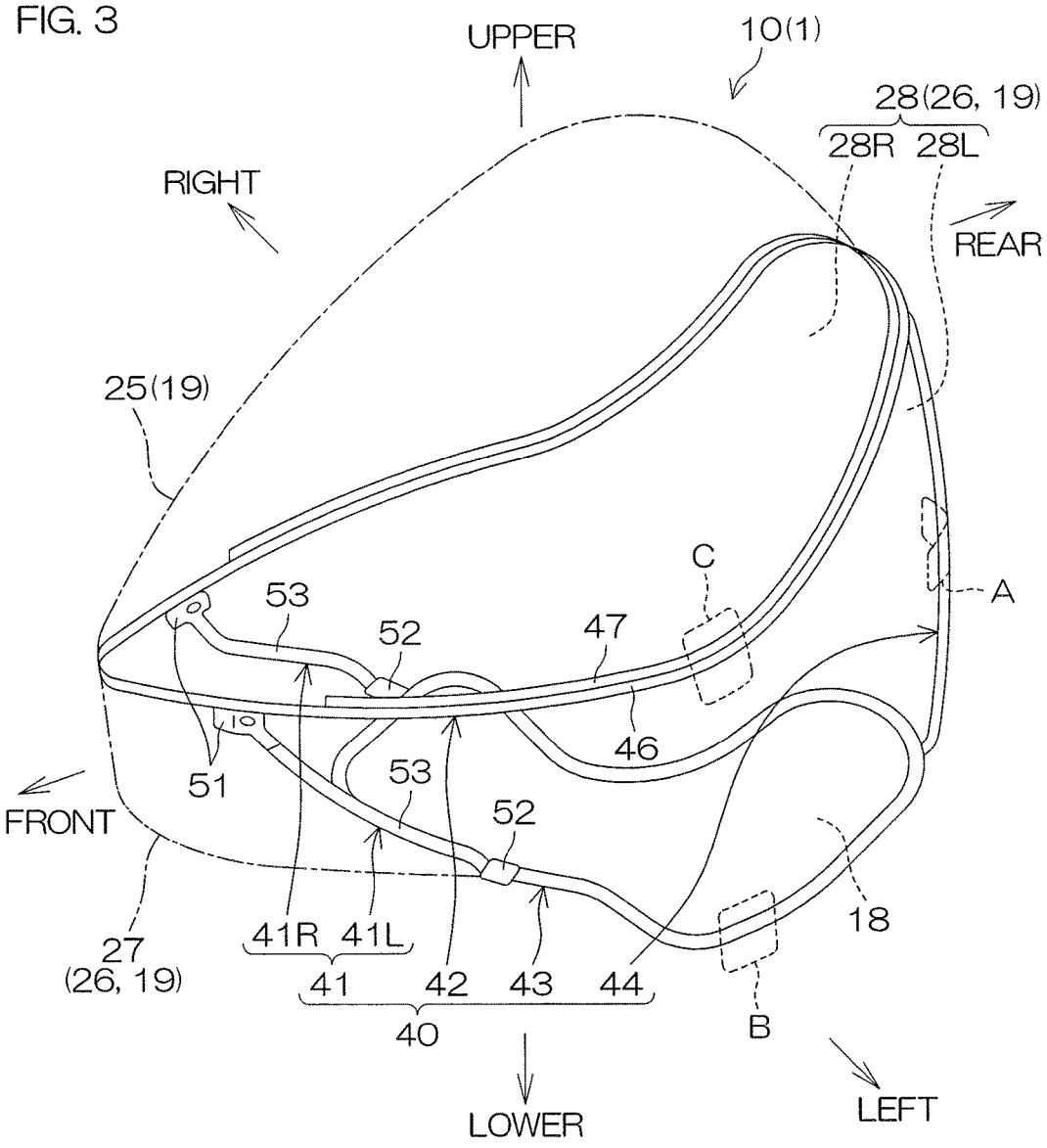
FIG. 3 is a perspective view of a sealing structure for a divisible engine cover in the outboard motor main body.

A boundary exists between the mount 18 and the engine cover 19 and multiple boundaries exist also in the engine cover 19 itself. The multiple boundaries in the engine cover 19 are, for example, one between the top portion 25 and the front bottom portion 27 and ones between the two portions of the front bottom portion 27 and each side bottom portion 28 (referred to as a second boundary B2; see FIG. 20 below). The boundary between the top portion 25 and each side bottom portion 28 and the boundary between the pair of side bottom portions 28 also exist as boundaries in the engine cover 19. An air-intake structure (not shown) of the engine 13 including, for example, an air-intake box and a throttle body is located at a position within the engine cover 19 higher than those of the boundary between the top portion 25 and the front bottom portion 27 and the boundary between the top portion 25 and each side bottom portion 28. The boundary spanning the three portions of the top portion 25, the front bottom portion 27, and each side bottom portion 28 (referred to as a first boundary B1; see FIG. 1) also exists as a boundary in the engine cover 19. The first boundary B1 and the second boundary B2 are continuous with each other. There further exists a boundary spanning the three portions of the mount 18, the front bottom portion 27, and each side bottom portion 28. The outboard motor 1 includes a sealing structure 40 that seals all of these boundaries. FIG. 3 is a perspective view of the sealing structure 40.

The sealing structure 40 includes a first seal 41, a second seal 42, a third seal 43, and a fourth seal 44. The fourth seal 44, the third seal 43, the second seal 42, and the first seal 41 will hereinafter be described in this order.

Figure 4:
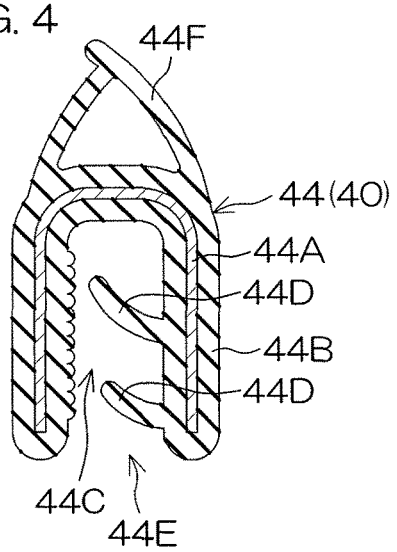
FIG. 4 is a schematic cross-sectional view showing a natural state prior to deformation of a fourth seal in the sealing structure.

The fourth seal 44 preferably has a vertically extending columnar shape between the couplings 28C of the pair of side bottom portions 28. The cross-section of the fourth seal 44 in the direction perpendicular or substantially perpendicular to the direction in which the fourth seal 44 extends has a structure shown in FIG. 4 at any position in the extending direction of the fourth seal 44. The fourth seal 44 includes a core portion 44A made of, for example, metal such as iron and an elastic portion 44B made of, for example, rubber and coating the entire core portion 44A. The core portion 44A preferably has a U-shaped or substantially U-shaped cross-section and the elastic portion 44B also preferably has a U-shaped or substantially U-shaped cross-section corresponding to the core portion 44A. It is noted that in this preferred embodiment, the rubber is, for example, a thermoplastic elastomer. The elastic portion 44B includes a tongue-shaped first protrusion 44D protruding into a concave space 44C sandwiched between the core portion 44A. The first protrusion 44D is provided on one of a pair of flat regions of the inner surface of the elastic portion 44B extending parallel or substantially parallel to each other with the space 44C sandwiched therebetween and protrudes in a manner away from an opening 44E of the space 44C. Multiple first protrusions 44D may be provided and, in this preferred embodiment, two first protrusions 44D are arranged parallel or substantially parallel to each other. The elastic portion 44B includes a second protrusion 44F protruding in a direction away from the opening 44E of the space 44C. The second protrusion 44F is hollow and preferably has a triangular or substantially triangular cross-section narrowing in the direction away from the opening 44E. The curved portion of the core portion 44A is positioned between the space 44C and the second protrusion 44F.

Figure 5:
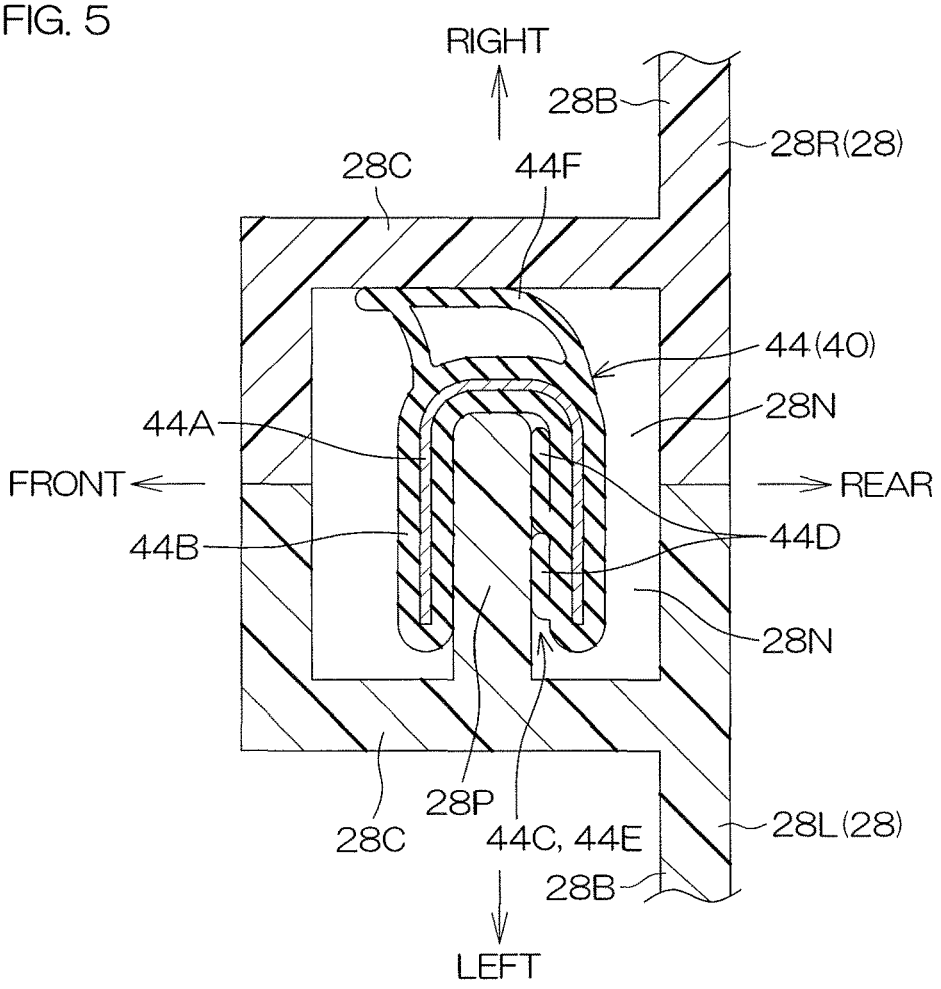
FIG. 5 is a schematic horizontal cross-sectional view of the engine cover in the region A of FIG. 3.

FIG. 5 is a schematic horizontal cross-sectional view of the engine cover 19 in the region A of FIG. 3. As for the fourth seal 44, the coupling 28C of each side bottom portion 28 preferably has a columnar shape protruding forward from the rear surface of the extended portion 28B and extending in the vertical direction. In each coupling 28C of each side bottom portion 28, a vertically extending groove 28N is provided in a region opposing the other coupling 28C. The grooves 28N of each other's side bottom portions 28 abut each other and are integral. One of the side bottom portions 28 (side bottom portion 28L in this preferred embodiment) is only provided integrally with a rib 28P protruding from the bottom of the groove 28N and extending in the vertical direction.

The fourth seal 44 spans the grooves 28N of both side bottom portions 28. In this state, the rib 28P of the side bottom portion 28L is fitted in the space 44C of the fourth seal 44. In the fourth seal 44, the elastic portion 44B surrounds the rib 28P and the first protrusion 44D in the front to back direction and is deformed in a manner following the rib 28P and, in this state, adheres tightly to the rib 28P. The second protrusion 44F is also deformed in a manner sandwiched between the leading end of the rib 28P and the bottom of the groove 28N in the side bottom portion 28R to adhere tightly to the bottom of the groove 28N. This causes the boundary between the couplings 28C of the pair of side bottom portions 28 to be sealed entirely in the vertical direction by the fourth seal 44.

Figure 6:
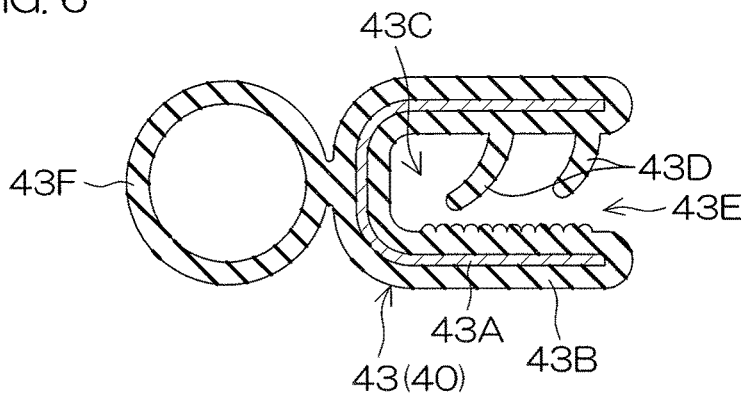
FIG. 6 is a schematic cross-sectional view showing a natural state prior to deformation of a third seal in the sealing structure.

The third seal 43 preferably has an annular shape extending along the annular body defined by the fitting groove 27C in the front bottom portion 27 and the fitting grooves 28K in the side bottom portions 28 (see FIGS. 2 and 3). The cross-section of the third seal 43 in the direction perpendicular or substantially perpendicular to the direction in which the third seal 43 extends has a structure shown in FIG. 6 at any position in the extending direction of the third seal 43. The third seal 43 includes a core portion 43A made of, for example, metal and an elastic portion 43B made of, for example, rubber and coating the entire core portion 43A. The core portion 43A preferably has a U-shaped or substantially U-shaped cross-section and the elastic portion 43B also preferably has a U-shaped or substantially U-shaped cross-section corresponding to the core portion 43A. The elastic portion 43B includes a tongue-shaped first protrusion 43D protruding into a concave space 43C sandwiched between the core portion 43A. The first protrusion 43D is provided on one of a pair of flat regions of the inner surface of the elastic portion 43B extending parallel or substantially parallel to each other with the space 43C sandwiched therebetween and protrudes in a manner away from an opening 43E of the space 43C. Multiple first protrusions 43D may be provided and, in this preferred embodiment, two first protrusions 43D are arranged parallel or substantially parallel to each other. The elastic portion 43B includes a second protrusion 43F protruding in a direction away from the opening 43E of the space 43C. The second protrusion 43F preferably has a circular cross-section, for example. The curved portion of the core portion 43A is positioned between the space 43C and the second protrusion 43F.

Figure 7:
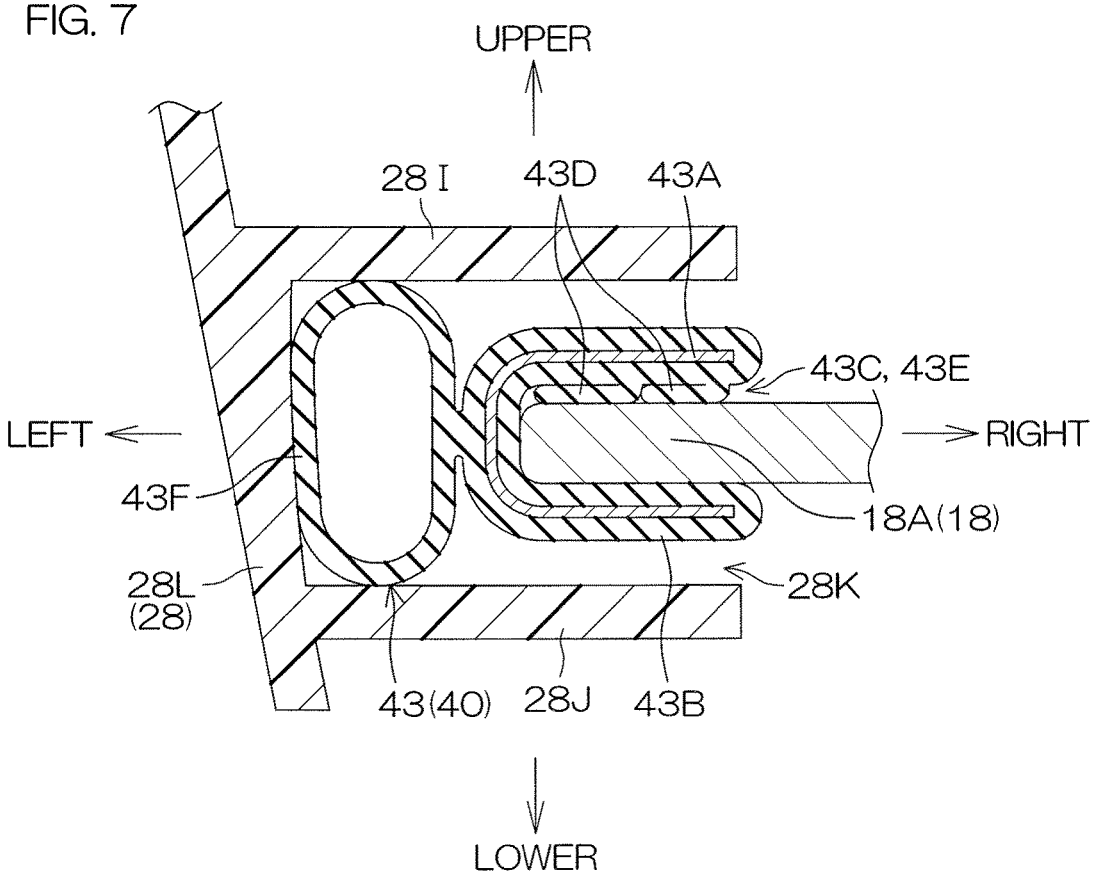
FIG. 7 is a schematic vertical cross-sectional view of the engine cover in the region B of FIG. 3.

FIG. 7 is a schematic vertical cross-sectional rear view of the engine cover 19 in the region B of FIG. 3. The third seal 43 spans the fitting groove 27C in the front bottom portion 27 and the fitting groove 28K in each side bottom portion 28 (the fitting groove 28K in the side bottom portion 28L in FIG. 7). In this state, the outer edge 18A of the mount 18 is fitted in the space 43C of the third seal 43. In the third seal 43, the elastic portion 43B vertically sandwiches the outer edge 18A and the first protrusion 43D is deformed in a manner following the outer edge 18A and, in this state, adheres tightly to the outer edge 18A from above. The second protrusion 43F is also deformed in a manner sandwiched between the outer edge 18A and the bottoms of the respective fitting grooves 27C and 28K to adhere tightly to the bottoms of these fitting grooves. This causes the boundary between the mount 18 and the front bottom portion 27 and the boundary between the mount 18 and each side bottom portion 28 to be sealed together around the entire circumference of the outer edge 18A by the third seal 43.

Figure 8:
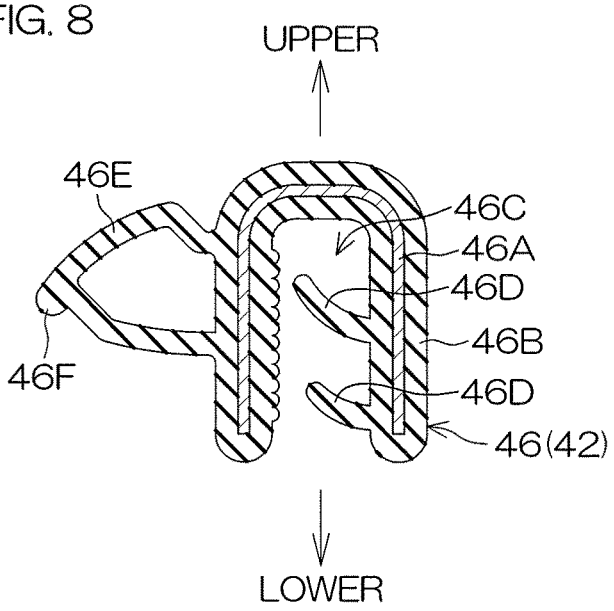
FIG. 8 is a schematic cross-sectional view showing a natural state prior to deformation of a second lower seal in the sealing structure.

The second seal 42 includes a second lower seal 46 and a second upper seal 47 (see FIG. 3). The second lower seal 46 preferably has an annular shape extending along the annular body defined by the upper end 27G of the front bottom portion 27 and the upper ends 28E of the side bottom portions 28. The cross-section of the second lower seal 46 in the direction perpendicular or substantially perpendicular to the direction in which the second lower seal 46 extends has a structure shown in FIG. 8 at any position in the extending direction of the second lower seal 46.

The second lower seal 46 includes a core portion 46A made of, for example, metal and an elastic portion 46B made of, for example, rubber and coating the entire core portion 46A. The core portion 46A preferably has a vertically inverted U-shaped or substantially U-shaped cross-section and the elastic portion 46B also preferably has a U-shaped or substantially U-shaped cross-section corresponding to the core portion 46A. The concave space 46C sandwiched between the core portion 46A opens downward. The elastic portion 46B includes a tongue-shaped first protrusion 46D protruding upward into the space 46C. The first protrusion 46D is provided on one of a pair of flat regions (right flat region in FIG. 8) of the inner surface of the elastic portion 46B extending parallel or substantially parallel to each other with the space 46C sandwiched therebetween and protrudes obliquely upward. Multiple first protrusions 46D may be provided and, in this preferred embodiment, two first protrusions 46D are arranged parallel or substantially parallel to each other. The elastic portion 46B includes, on its side surface (left side surface in FIG. 8), a second protrusion 46E protruding in a direction away from the space 46C. The straight portion of the core portion 46A is positioned between the space 46C and the second protrusion 46E. The second protrusion 46E is hollow and preferably has a triangular or substantially triangular cross-section narrowing in the direction away from the space 46C.

Figure 9:
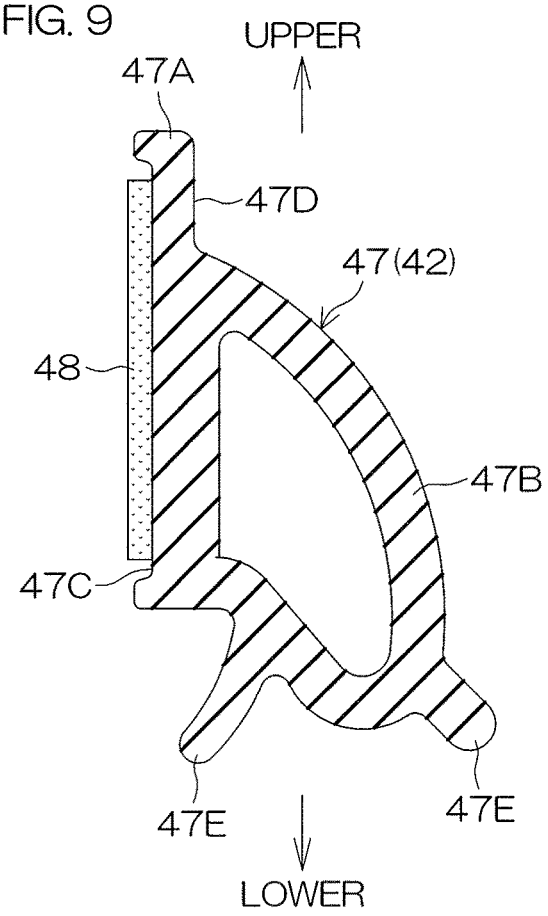
FIG. 9 is a schematic cross-sectional view showing a natural state prior to deformation of a second upper seal in the sealing structure.

The second upper seal 47 is made of, for example, rubber and preferably has a band shape extending along a portion of the second lower seal 46 (see FIG. 3). The cross-section of the second upper seal 47 in the direction perpendicular or substantially perpendicular to the direction in which the second upper seal 47 extends has a structure shown in FIG. 9 at any position in the extending direction of the second upper seal 47. The second upper seal 47 integrally includes a fixed portion 47A and a protrusion 47B. The fixed portion 47A preferably has a vertical plate shape. Adhesive 48 is provided on a side surface 47C of the fixed portion 47A. The protrusion 47B protrudes from the side surface 47D opposite to the side surface 47C of the fixed portion 47A. The protrusion 47B is hollow and preferably has a triangular or substantially triangular cross-section narrowing in the direction away from the side surfaces 47C and 47D. A pair of convex portions 47E protruding downward are provided at lower portions of the protrusion 47B. One of the convex portions 47E protrudes in a manner coming close to the fixed portion 47A as it extends downward, while the other convex portion 47E protrudes in a manner away from the fixed portion 47A as it extends downward.

Figure 10:
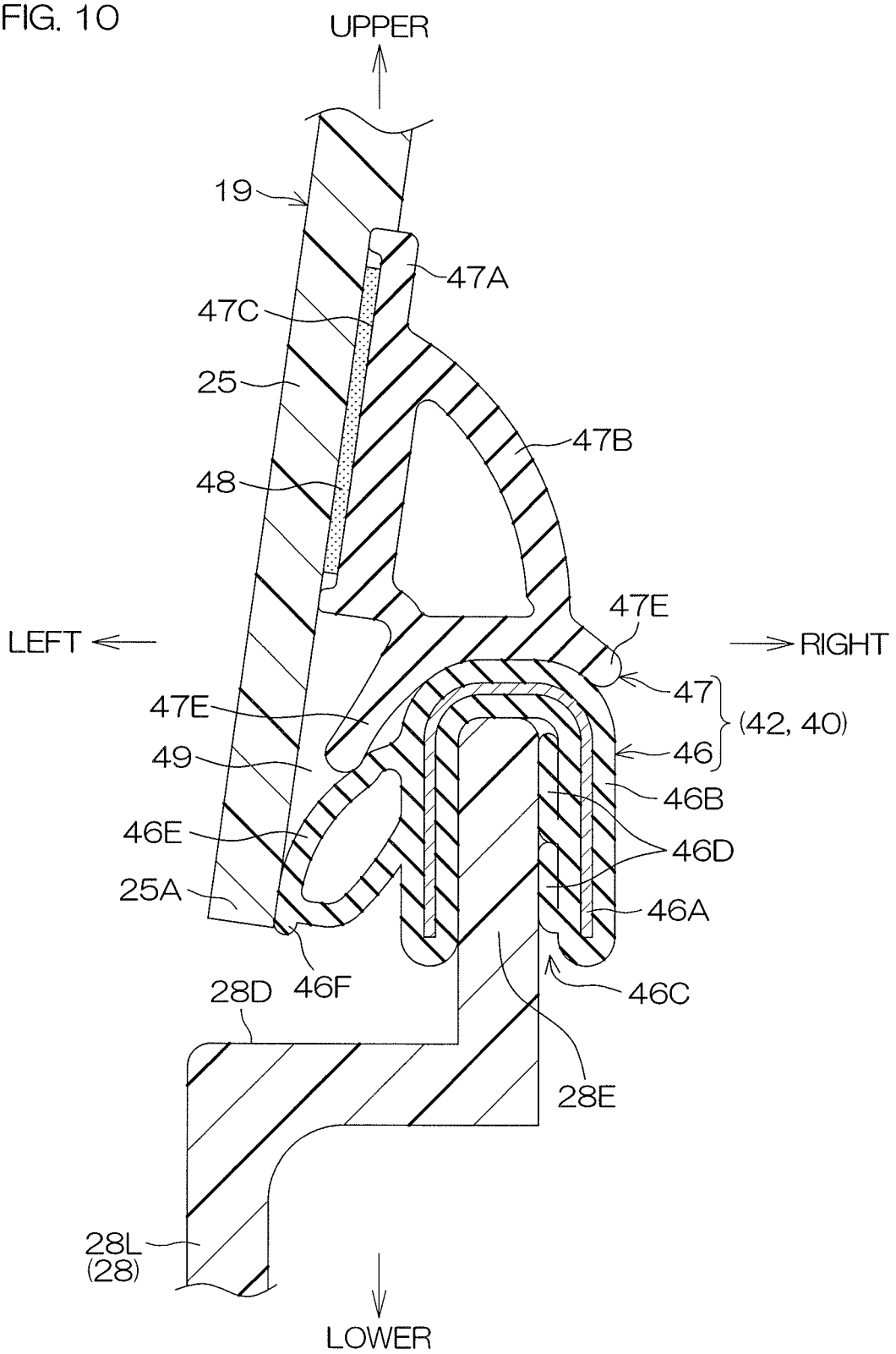
FIG. 10 is a schematic vertical cross-sectional view of the engine cover in the region C of FIG. 3.

FIG. 10 is a schematic vertical cross-sectional rear view of the engine cover 19 in the region C of FIG. 3. The upper end 27G of the front bottom portion 27 and the upper ends 28E of the side bottom portions 28 (only the upper end 28E of the side bottom portion 28L is shown in FIG. 10) are fitted in the space 46C of the second lower seal 46 from below. In the second lower seal 46, the elastic portion 46B laterally sandwiches the upper end 28E and the first protrusion 46D is deformed in a manner following the upper end 28E and, in this state, laterally adheres tightly to the upper end 28E (from the right in FIG. 10). In addition, the second protrusion 46E is deformed in a manner hanging downward to adhere tightly to the lower edge 25A of the top portion 25 from within the engine cover 19. This causes the boundary between the top portion 25 and the front bottom portion 27 and the boundary between the top portion 25 and each side bottom portion 28 to be sealed together around the entire circumference of the lower edge 25A by the second lower seal 46. It is noted that the second protrusion 46E may adhere tightly to the lower edge 25A only laterally (see FIGS. 16 and 20 below) or may adhere tightly to the lower edge 25A from below at the leading end 46F of the second protrusion 46E, as shown in FIG. 10.

The second upper seal 47 is located on a region rearward of the front portion of the second lower seal 46 and preferably is U-shaped or substantially U-shaped in plan view (see FIG. 3). The fixed portion 47A of the second upper seal 47 follows the lower end of the inner surface of the top portion 25 and is applied to the top portion 25 via the adhesive 48. The protrusion 47B of the second upper seal 47 is positioned over the second lower seal 46 and adheres tightly to the second lower seal 46 with the pair of convex portions 47E sandwiching an upper portion of the second lower seal 46. This causes the clearance gap 49 sandwiched between the inner surface of the top portion 25 and the second protrusion 46E of the second lower seal 46 to be closed by the second upper seal 47 from above and inhibits the clearance gap 49 from accumulating water therein. It is noted that since the second lower seal 46 and the second upper seal 47 are offset upward as they extend rearward (see FIG. 3), the clearance gap 49 is also inclined. With this configuration, even if water enters the clearance gap 49, the water flows down through the clearance gap 49 and is discharged out of the clearance gap 49.

A pair of left and right first seals 41 are provided correspondingly to the pair of left and right side bottom portions 28 (see FIG. 3). Of the pair of left and right first seals 41, the left first seal 41 will be referred to as a first seal 41L, while the right first seal 41 will be referred to as a first seal 41R. The first seal 41L and the first seal 41R are preferably laterally symmetric. While the first seals 41 will hereinafter be described focusing on the first seal 41L, the following description of the first seal 41L, when reversed laterally, corresponds to description of the first seal 41R.

Figure 11:
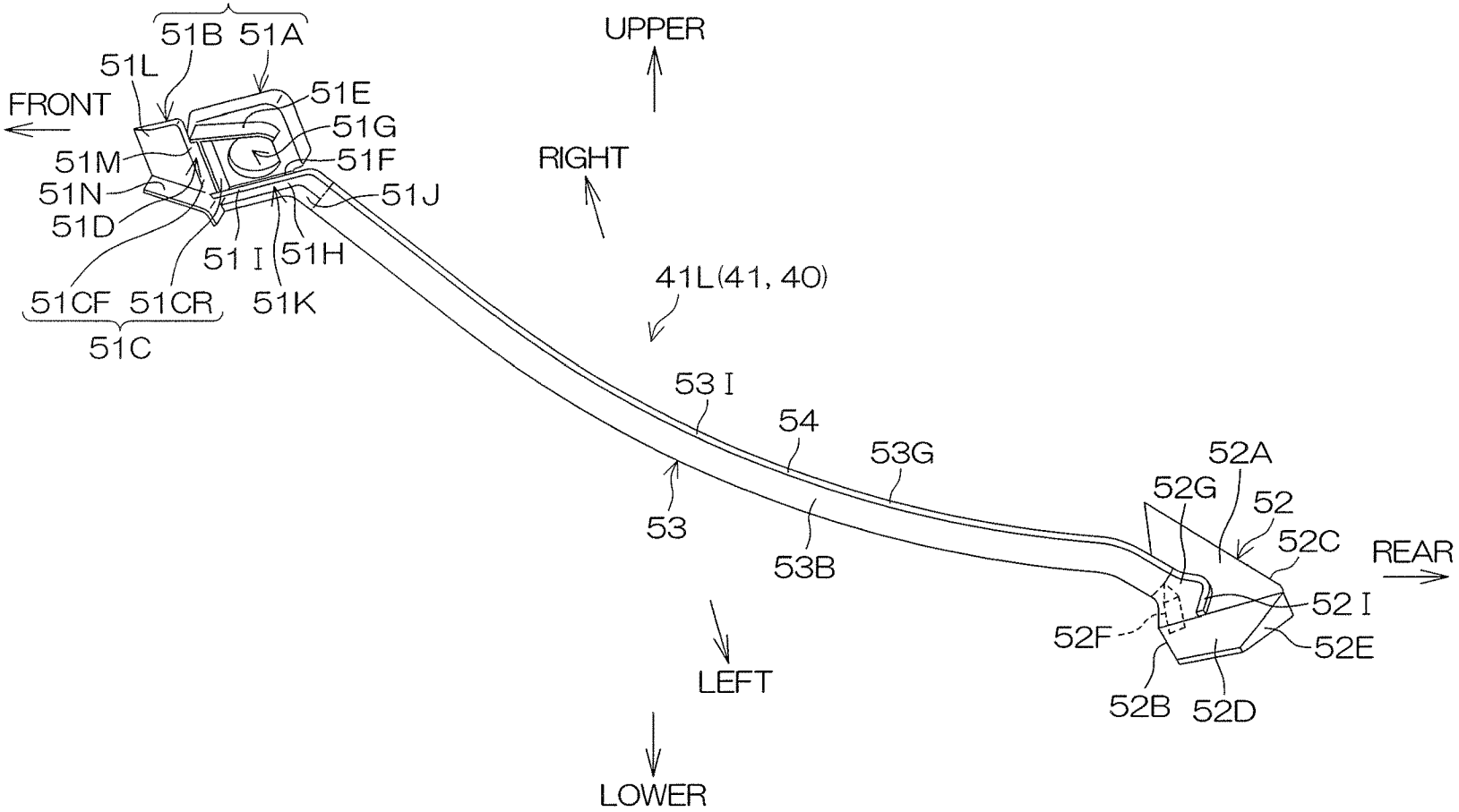
FIG. 11 is a schematic perspective view of a first seal in the sealing structure.

FIG. 11 is a schematic perspective view of the first seal 41L. The first seal 41L integrally includes a first portion 51 exemplifying a three-part seal, a second portion 52, and a third portion 53 exemplifying a two-part seal. The first portion 51 is arranged at a position higher than that of the second portion 52 and the third portion 53 extends from the first portion 51 to the second portion 52. The first portion 51 and the second portion 52 are, for example, rubber molded articles and the third portion 53 is a rubber extrusion molded article inserted in the molded articles. In FIG. 11, the joint between the first portion 51 and the third portion 53 and the joint between the second portion 52 and the third portion 53 are respectively indicated by alternate long and short dashed lines. The first portion 51, the second portion 52, and the third portion 53 are preferably made of the same rubber material. The first portion 51, the second portion 52, and the third portion 53 will hereinafter be described in this order.

The first portion 51 integrally includes an inner portion 51A and an outer portion 51B. The inner portion 51A preferably has a plate shape with its thickness direction coinciding or substantially coinciding with the lateral direction. The upper edge and the rear edge of the inner portion 51A are bent rightward. A pair of anteroposterior vertical ribs 51C protruding leftward and extending vertically and parallel or substantially parallel to each other are provided in a front end of the left surface of the inner portion 51A. Of the pair of vertical ribs 51C, the forward vertical rib 51C may be referred to as a vertical rib 51CF, while the rearward vertical rib 51C may be referred to as a vertical rib 51CR. The vertical rib 51CF defines a front edge of the inner portion 51A bent leftward. A vertically extending water storage groove 51D is located between and defined by the two vertical ribs 51C.

An upper rib 51E protruding leftward is provided at a position of the left surface of the inner portion 51A below and adjacent to the upper edge. The upper rib 51E is connected to the upper end of the vertical rib 51CF to close the upper end of the water storage groove 51D and extends rearward from the upper end of the water storage groove 51D to just before the rear edge of the inner portion 51A. A rear end of the upper rib 51E may be curved downward. A guide 51F is provided in a lower end of the left surface of the inner portion 51A. The guide 51F is a leftward protruding rib connected to a lower end of the vertical rib 51CF to close the lower end of the water storage groove 51D and extends rearward from the lower end of the water storage groove 51D to just before the rear edge of the inner portion 51A. An insertion hole 51G laterally penetrates a portion of the inner portion 51A that is rearward of the water storage groove 51D and is vertically sandwiched between the upper rib 51E and the guide 51F.

The inner portion 51A further includes an extended portion 51H extending leftward from the left end of the guide 51F and a lower rib 51I protruding leftward and upward from the boundary between the guide 51F and the extended portion 51H. The extended portion 51H is connected to the lower end of the vertical rib 51CF and extends rearward behind the guide 51F. A rear portion 51J of the extended portion 51H is curved downward. A left end of the rear portion 51J is bent downward. The lower rib 51I is connected to the lower end of the vertical rib 51CF and extends along the extended portion 51H. A drainage groove 51K is located between and defined by the extended portion 51H and the lower rib 51I. The drainage groove 51K extends rearward from the lower end of the vertical rib 51CF to be curved downward and opens leftward.

The outer portion 51B preferably has a plate shape with its thickness direction coinciding or substantially coinciding with the lateral direction and inclined with respect to the inner portion 51A in plan view so as to be offset rightward as it extends forward. An upper end 51L of the outer portion 51B protrudes upward above the inner portion 51A. The upper end edge of the outer portion 51B is inclined so as to be offset downward as it extends forward. The rear edge 51M of the outer portion 51B is bent rightward. An upper end of the rear edge 51M defines a portion of the upper end 51L. The upper end of the rear edge 51M protrudes upward above the vertical rib 51CF of the inner portion 51A, and a portion of the rear edge 51M lower than the upper end is connected to the vertical rib 51CF from the left. The lower edge 51N of the outer portion 51B is bent leftward. A rear end of the lower edge 51N is bent downward and connected to the lower end of the vertical rib 51CF from the left. The rear edge 51M and the rear end of the lower edge 51N may be considered to be a portion of the vertical rib 51CF or the vertical rib 51CF may be considered to be a portion of the rear edge 51M and the lower edge 51N. The water storage groove 51D in the inner portion 51A is adjacent to the rear edge 51M from behind.

The second portion 52 preferably has a box shape and its interior space opens downward. The second portion 52 preferably has a triangular or substantially triangular top surface 52A, and a front surface 52B, a sealing surface 52C, and a tapered surface 52D extending downward from the three respective sides of the top surface 52A. The second portion 52 also includes a pressed surface 52E sandwiched between the sealing surface 52C and the tapered surface 52D.

The top surface 52A extends horizontally or substantially horizontally. The front surface 52B extends in or substantially in the lateral direction. A vertically extending positioning groove 52F is provided at a lateral intermediate position of the front surface 52B. The positioning groove 52F penetrates vertically through the second portion 52. A protrusion 52G defining the upper end of the positioning groove 52F and protruding upward is provided on the top surface 52A. The horizontal cross-section of the protrusion 52G preferably is U-shaped or substantially U-shaped narrowing rearward. A rear end of the protrusion 52G is the leading end of the protrusion 52G and is preferably hollow. The interior space in the leading end of the protrusion 52G defines an outlet 52H (see FIG. 17 below) opening downward from the interior space of the second portion 52.

A projection 52I protruding upward is provided on the top surface 52A. The projection 52I extends rearward from the leading end of the protrusion 52G to be bent leftward. The sealing surface 52C is connected to the right end edge of the front surface 52B and inclined so as to offset rearward as it extends leftward in plan view. The sealing surface 52C may be flat or curved in a manner recessed forward in plan view. The tapered surface 52D is connected to the left end edge of the front surface 52B and inclined so as to offset downward as it extends leftward. The rear end of the upper end edge of the tapered surface 52D is connected to the left end of the upper end edge of the sealing surface 52C. A lower end of the tapered surface 52D may be a vertical surface. The left end of the projection 52I is positioned at approximately the center of the upper end edge of the tapered surface 52D. The pressed surface 52E is bridged between the left end edge of the sealing surface 52C and the rear end edge of the tapered surface 52D and preferably has a triangular or substantially triangular shape widening downward. The pressed surface 52E is inclined so as to offset forward as it extends leftward in plan view.

Figure 12:
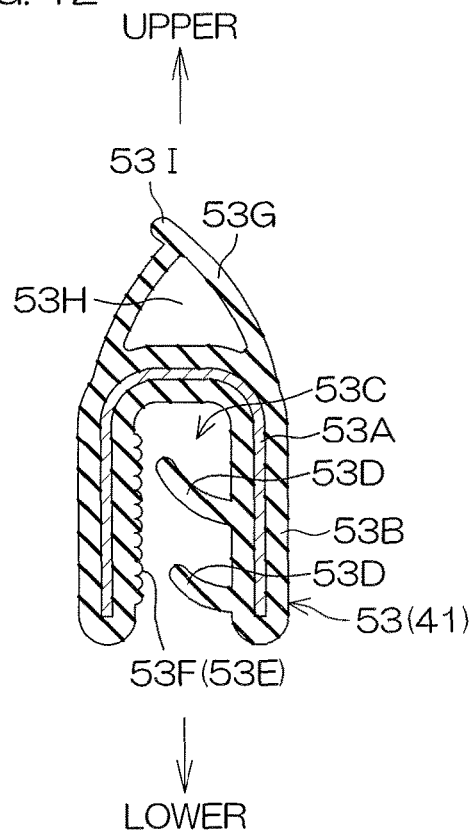
FIG. 12 is a schematic cross-sectional view showing a natural state prior to deformation of a third portion in the first seal.

The third portion 53 preferably has a columnar shape extending front to back between the first portion 51 and the second portion 52 in a manner inclined with respect to the horizontal direction. The cross-section of the third portion 53 in the direction perpendicular or substantially perpendicular to the direction in which the third portion 53 extends has a structure shown in FIG. 12 at any position in the extending direction of the third portion 53. The thus simply shaped third portion 53 having the same cross-section at any position is different in structure from the first portion 51 and the second portion 52 having their respective complex shapes.

The third portion 53 includes a core portion 53A made of, for example, metal and an elastic portion 53B made of, for example, rubber and coating the entire core portion 53A. The core portion 53A preferably has a vertically inverted U-shaped or substantially U-shaped cross-section and the elastic portion 53B also preferably has a U-shaped or substantially U-shaped cross-section corresponding to the core portion 53A. The concave space 53C sandwiched between the core portion 53A opens downward. A front end of the elastic portion 53B is connected to the rear portion 51J of the extended portion 51H and the lower rib 51I of the first portion 51, while a rear end of the elastic portion 53B is connected to the protrusion 52G of the second portion 52 (see FIG. 11).

The elastic portion 53B includes a tongue-shaped first protrusion 53D protruding leftward and upward in the space 53C. The first protrusion 53D is provided on one of a pair of left and right flat regions (right flat region in FIG. 12) of the inner surface of the elastic portion 53B extending parallel or substantially parallel to each other with the space 53C sandwiched therebetween. Multiple first protrusions 53D may be provided and, in this preferred embodiment, two first protrusions 53D are arranged parallel or substantially parallel to each other. A concavo-convex portion 53F defined by alternating concaves and convexes is provided vertically on the other one 53E of the pair of left and right flat regions (left flat region in FIG. 12) of the inner surface of the elastic portion 53B.

The elastic portion 53B includes a second protrusion 53G protruding upward from an upper end of the core portion 53A. The second protrusion 53G is hollow and preferably has a triangular or substantially triangular cross-section narrowing upward. The interior space of the second protrusion 53G defines a flow path 53H connected to the drainage groove 51K in the first portion 51 (see FIG. 11) and the outlet 52H of the second portion 52 (see FIG. 17).

Figure 13:
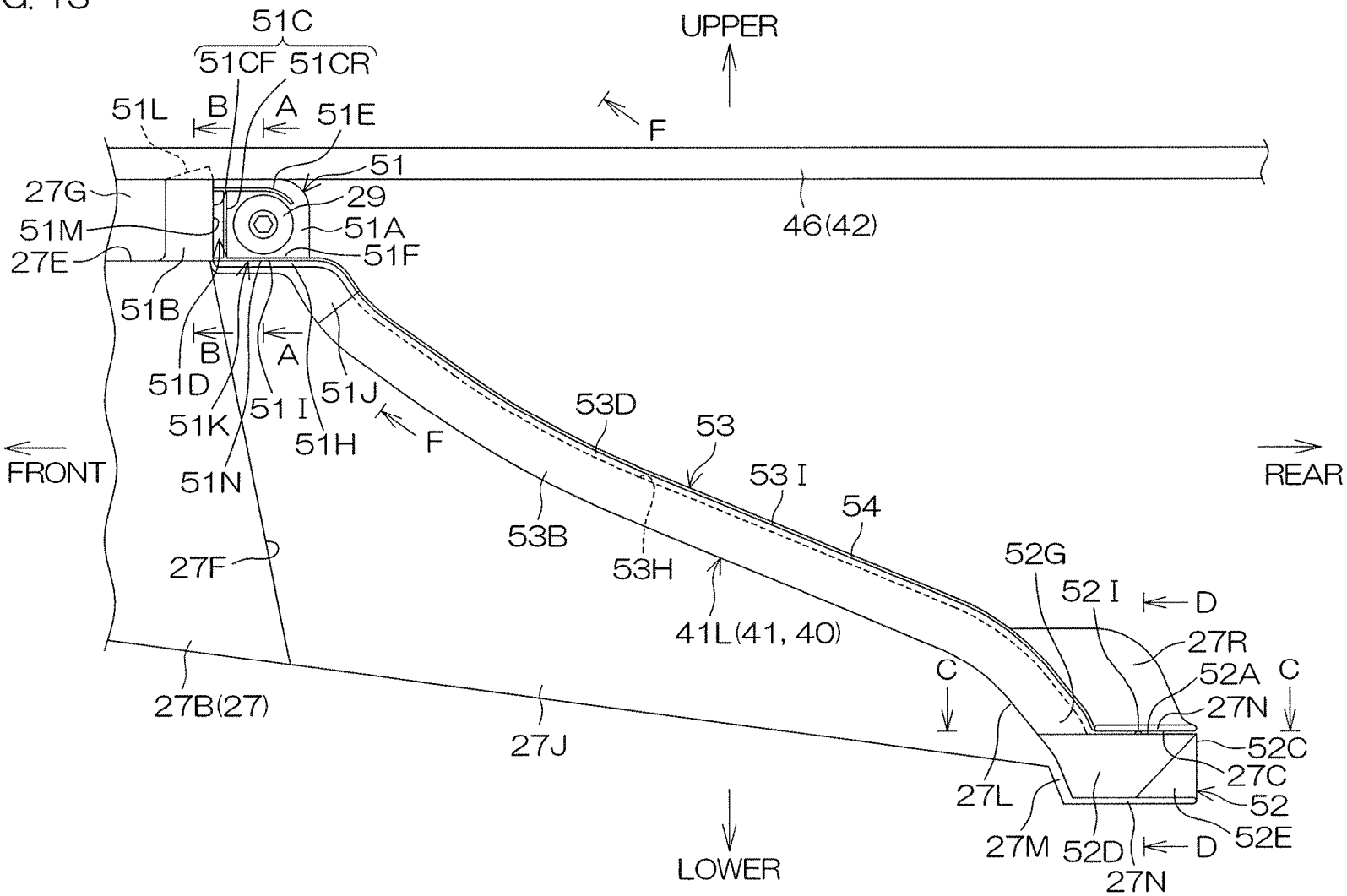
FIG. 13 is a schematic left side view of the first seal and its periphery.

FIG. 13 is a schematic left side view of the first seal 41L and its periphery. In FIG. 13, the front bottom portion 27 and the second lower seal 46 are shown as the periphery. The first seal 41L is arranged along the left opposing portion 27H in the upper end 27G of the front bottom portion 27 and the upper end edge of the left rear portion 27J of the vertical portion 27B. The first portion 51, the second portion 52, and the third portion 53 of the first seal 41L in this state will hereinafter be described in this order.

Figure 14:
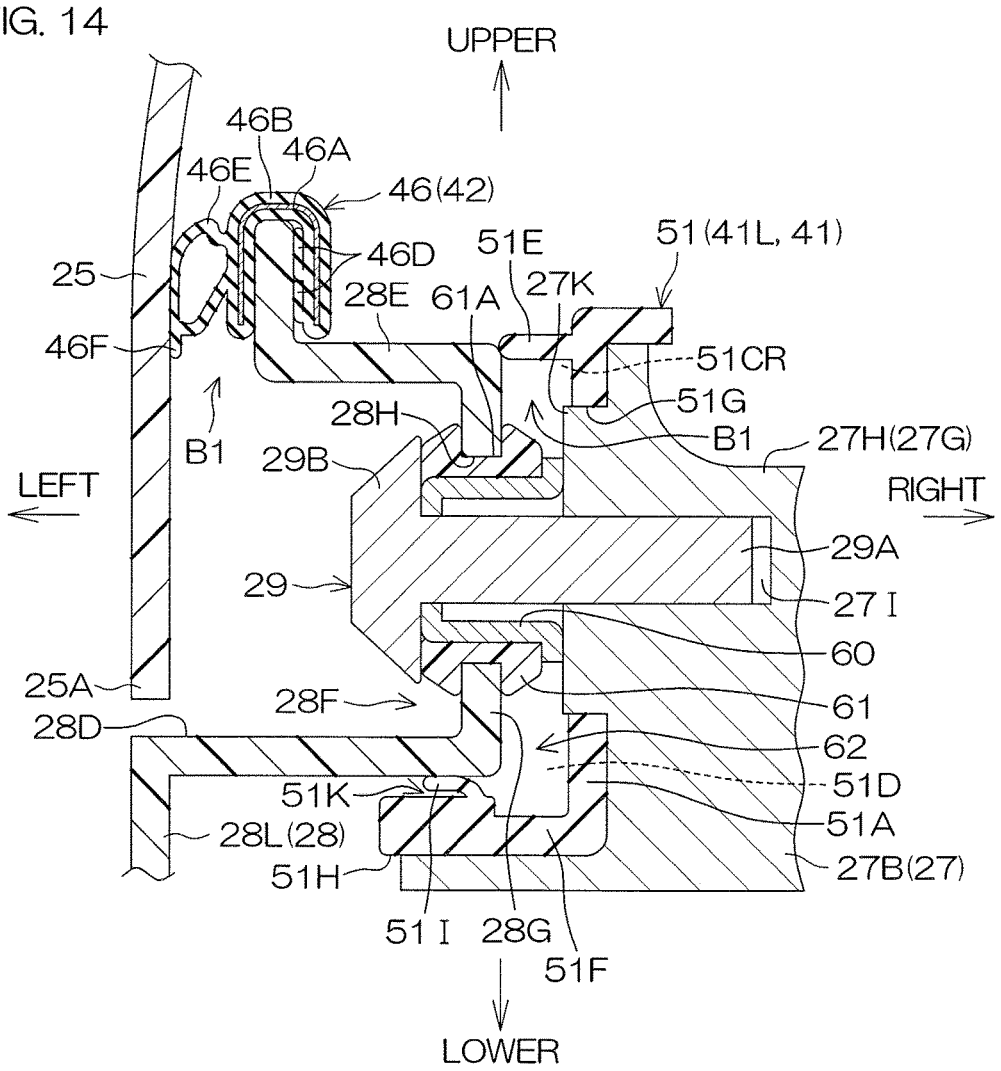
FIG. 14 is an end view of a cut portion along the line A-A in FIG. 13.

FIG. 14 is an end view of a cut portion along the line A-A in FIG. 13. At least a portion of the inner portion 51A of the first portion 51 is located between the left opposing portion 27H in the front bottom portion 27 and the bottom portion 28G of the recess 28F in the upper end 28E of the side bottom portion 28L. A raised portion 27K raised outward (leftward in FIG. 14) in a manner encompassing the screw hole 27I is provided on the outer surface (left surface in FIG. 14) of the opposing portion 27H. The raised portion 27K is fitted in the insertion hole 51G in the first portion 51 with no clearance gap. A screw portion 29A of the coupling member 29 that couples the opposing portion 27H and the side bottom portion 28L is assembled into the screw hole 27I while being inserted through the insertion hole 51G. Between a head portion 29B of the coupling member 29 and the raised portion 27K, there is interposed a cylindrical collar 60 encompassing the screw portion 29A and a cylindrical grommet 61 fitted in the insertion hole 28H in the bottom portion 28G while encompassing the collar 60. By way of example, the collar 60 is preferably made of metal, while the grommet 61 is preferably made of resin. A peripheral portion of the insertion hole 28H in the side bottom portion 28L is fitted entirely with no clearance gap in a fitting groove 61A provided in the outer peripheral surface of the grommet 61.

The upper edge of the inner portion 51A is engaged with the opposing portion 27H from above, while the rear edge of the inner portion 51A is engaged with the opposing portion 27H from behind. In the inner portion 51A, the vertical rib 51CR, the upper rib 51E, and the lower rib 51I protrude toward the upper end 28E of the side bottom portion 28L and adhere tightly to the inner surface of the side bottom portion 28L. Specifically, the vertical rib 51CR and the upper rib 51E extend leftward to adhere tightly to the right surface of the bottom portion 28G in the upper end 28E, while the lower rib 51I is deformed in a manner following the lower surface of the bottom portion 28G to adhere tightly to the lower surface of the bottom portion 28G. Accordingly, the clearance gap 62 between the opposing portion 27H and the bottom portion 28G is closed by the vertical rib 51CR from the front and also closed by the upper rib 51E and the lower rib 51I from above and below to be opened only rearward. The water storage groove 51D in the inner portion 51A, which is positioned forward of the vertical rib 51CR, is opposed to the upper end 28E of the side bottom portion 28L (particularly a region of the right surface of the bottom portion 28G forward of the insertion hole 28H).

Figure 15:
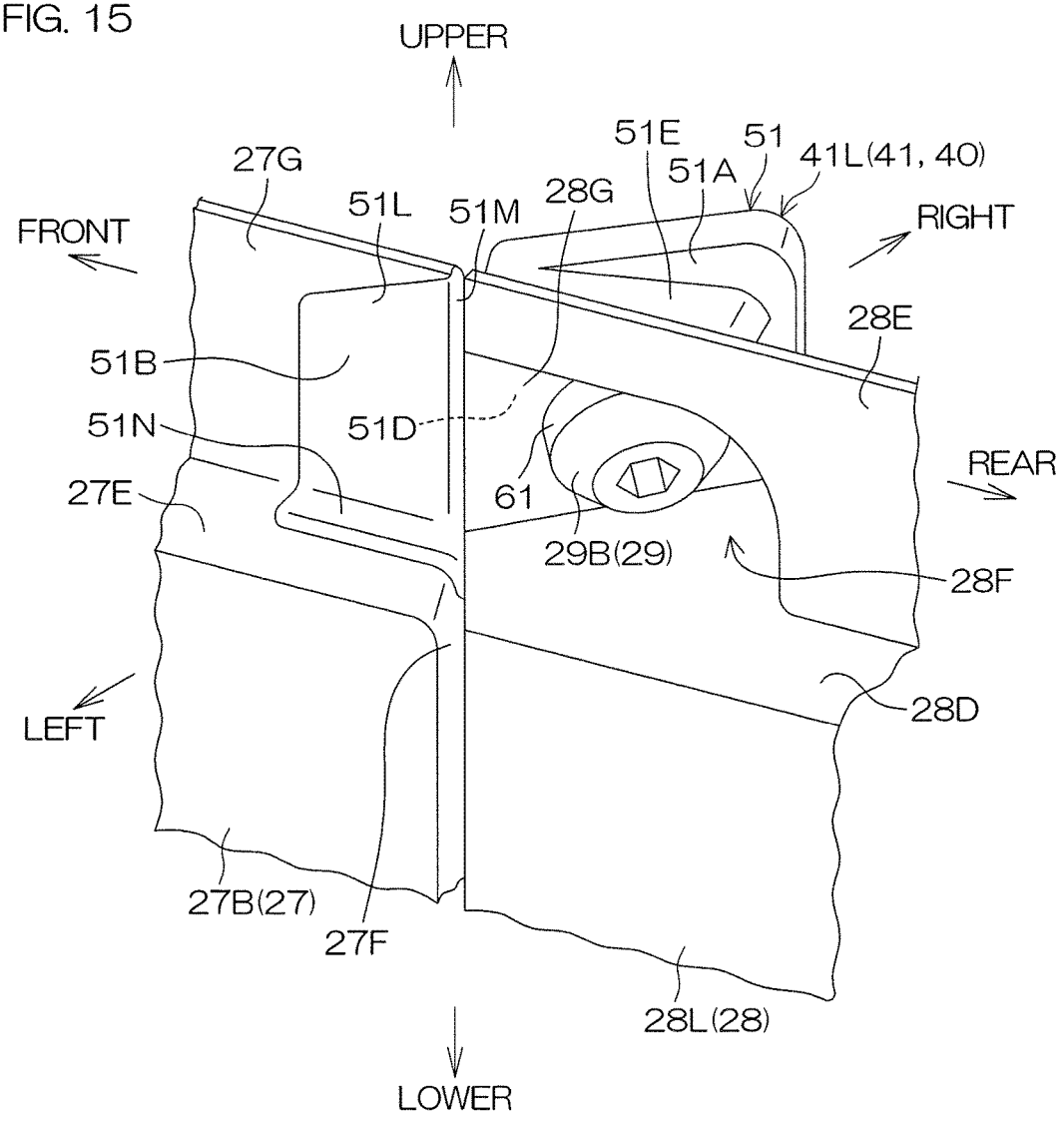
FIG. 15 is a schematic perspective view of the first portion of the first seal and its periphery.

FIG. 15 is a schematic perspective view of the first portion 51 and its periphery. In FIG. 15, the front bottom portion 27 and the side bottom portion 28L are shown as the periphery. The outer portion 51B of the first portion 51 is arranged on the outer surface of the upper end 27G of the front bottom portion 27, and the rear edge 51M of the outer portion 51B closes the boundary between the outer surface of the upper end 27G of the front bottom portion 27 and the outer surface of the upper end 28E of the side bottom portion 28L. That is, the outer portion 51B is arranged on the outer surface of the upper end 27G of the front bottom portion 27 through the boundary. It is noted that the rear edge 51M in this state is not compressed between the front bottom portion 27 and the side bottom portion 28L and therefore cannot resist against the movement of the side bottom portion 28L during its application or removal. This allows the operator to apply and remove the side bottom portion 28L smoothly. The lower edge 51N of the outer portion 51B is arranged along a left rear end of the horizontal step 27E and an upper end of the left vertical step 27F.

Figure 16:
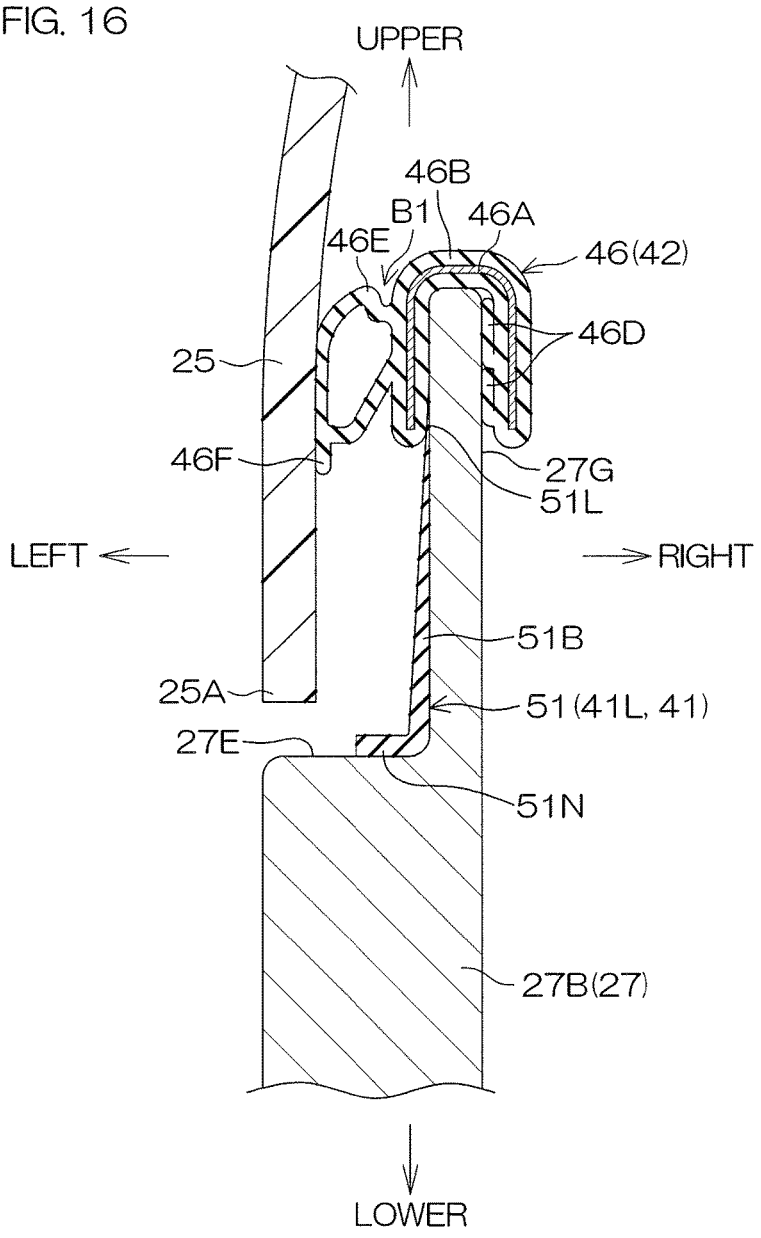
FIG. 16 is an end view of a cut portion along the line B-B in FIG. 13.

FIG. 16 is an end view of a cut portion along the line B-B in FIG. 13. As mentioned above, the boundary between the top portion 25 and the front bottom portion 27 and the boundary between the top portion 25 and each side bottom portion 28 are sealed together by the second lower seal 46. The elastic portion 46B of the second lower seal 46 sandwiching the upper end 27G of the front bottom portion 27 sandwiches the upper end 51L, which is a portion of the outer portion 51B, between the same and the outer surface of the upper end 27G.

Accordingly, the first boundary B1 between the top portion 25, the front bottom portion 27, and the side bottom portion 28L is sealed by both the first portion 51 and the second lower seal 46.

Figure 17:
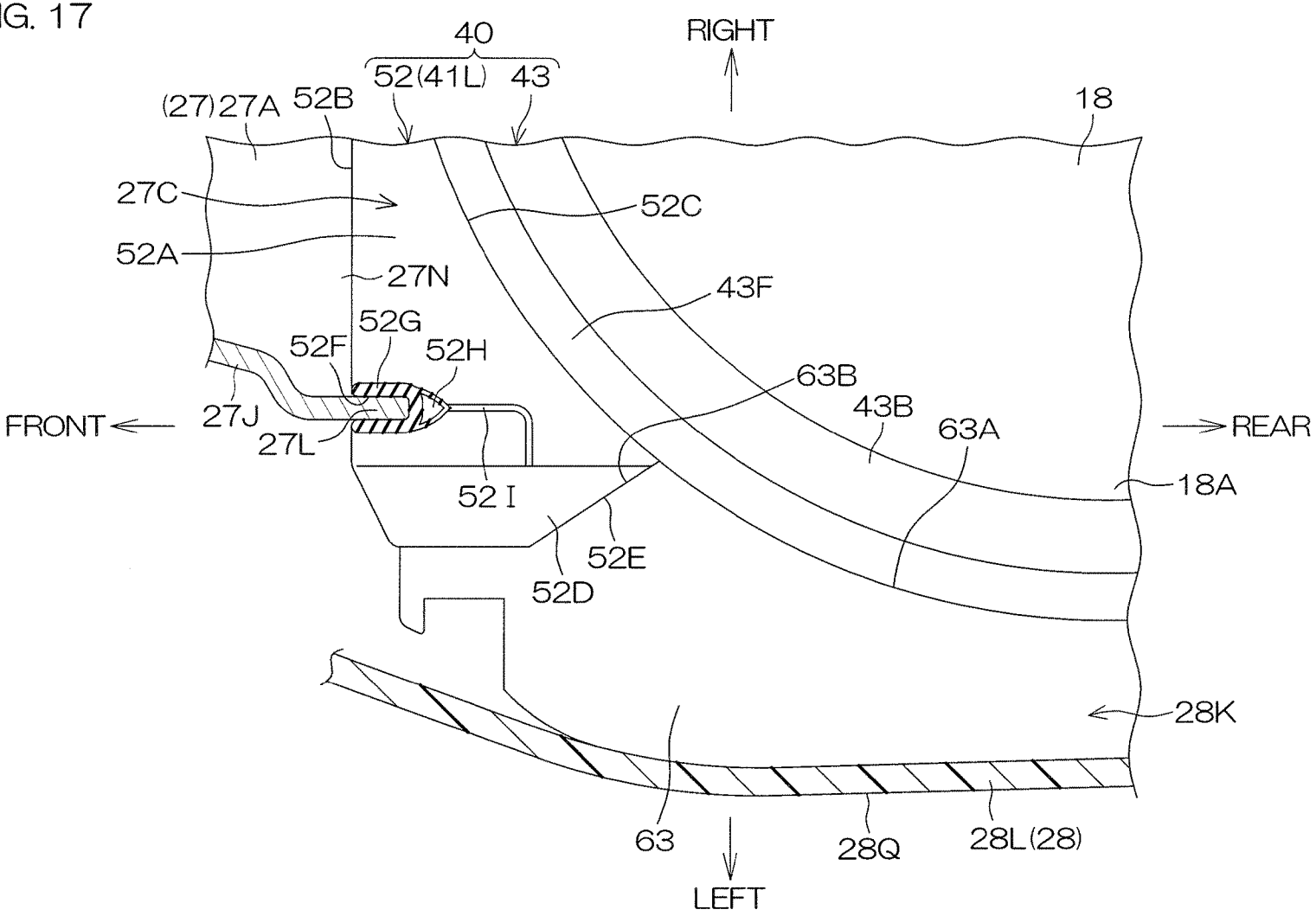
FIG. 17 is a cross-sectional view taken along the line C-C in FIG. 13.
Figure 18:
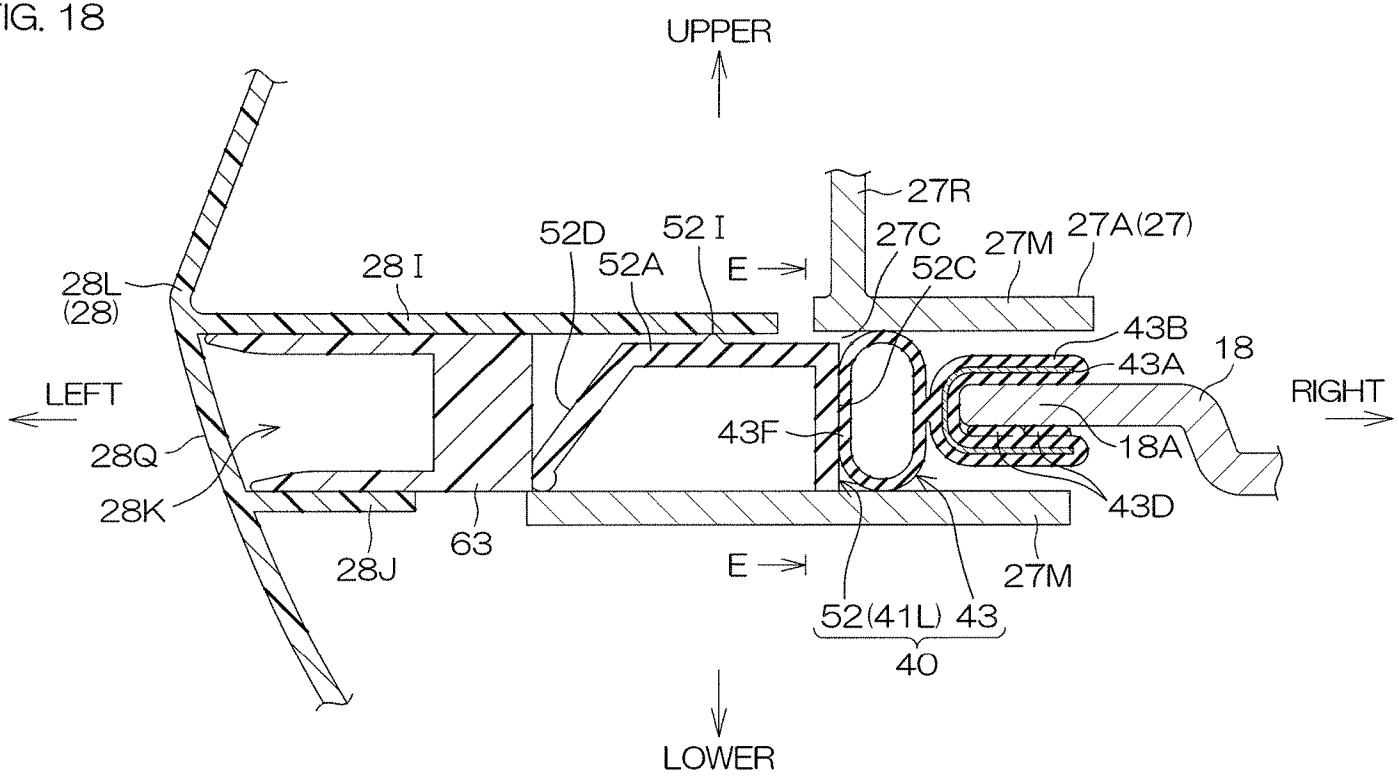
FIG. 18 is an end view of a cut portion along the line D-D in FIG. 13.
Figure 19:
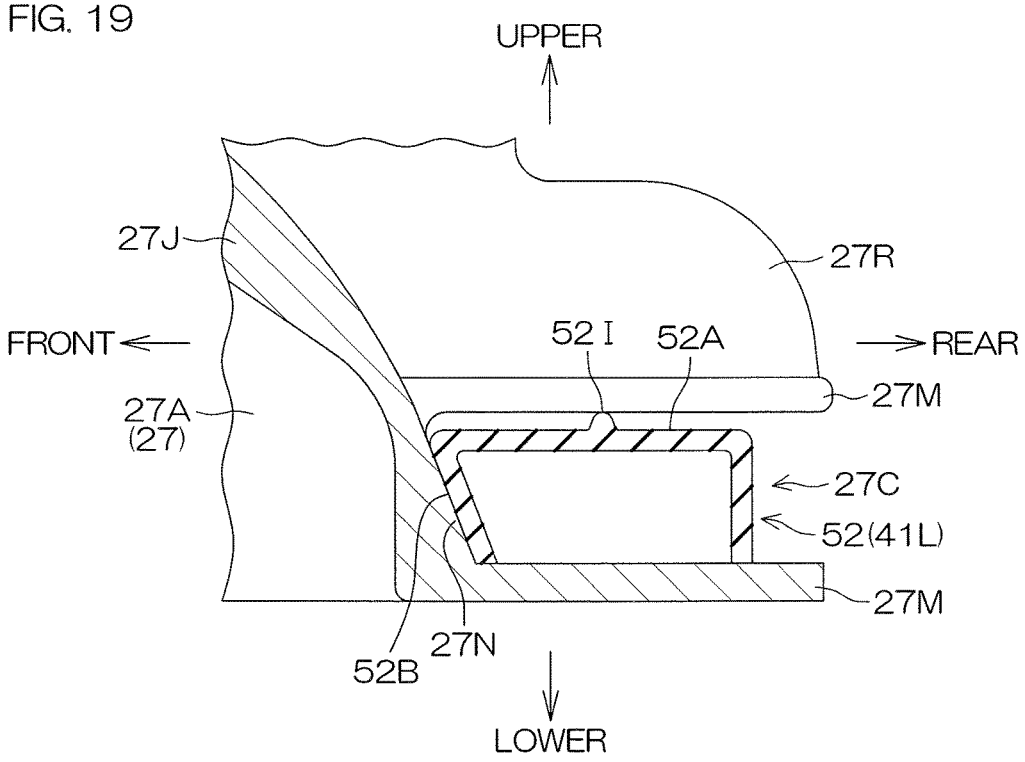
FIG. 19 is a cross-sectional view taken along the line E-E in FIG. 18.

FIG. 17 is a cross-sectional view taken along the line C-C in FIG. 13. FIG. 18 is an end view of a cut portion along the line D-D in FIG. 13. FIG. 19 is a cross-sectional view taken along the line E-E in FIG. 18. A right portion of the second portion 52 is housed in a left end of the fitting groove 27C in the front bottom portion 27 (see also FIG. 2). The sealing surface 52C of the second portion 52 is smoothly continuous with a region (not shown) of the bottom of the fitting groove 27C adjoining the second portion 52 from the right. The sealing surface 52C of the second portion 52 in this state adheres tightly to the second protrusion 43F of the third seal 43 from the front and left at the boundary between the front bottom portion 27, the mount 18, and the side bottom portion 28L. The positioning groove 52F and a portion of the second portion 52 to the left of the positioning groove 52F stick out leftward from the fitting groove 27C. A rear end of the left rear portion 27J in the vertical portion 27B of the front bottom portion 27 will be referred to as a positioning portion 27L. The positioning portion 27L is fitted in the positioning groove 52F from the front (see FIG. 17).

A pair of upper and lower horizontal walls 27M extending rearward parallel or substantially parallel to each other and a vertical wall 27N extending upward from the front end of the lower horizontal wall 27M are provided on the rear edge of the horizontal portion 27A of the front bottom portion (see FIG. 19). The fitting groove 27C in the front bottom portion 27 defines a space between the pair of horizontal walls 27M and the vertical wall 27N defines the bottom of the fitting groove 27C. The second portion 52, which is partially housed in the fitting groove 27C, is sandwiched vertically between the pair of horizontal walls 27M and in contact with the vertical wall 27N from behind. This causes the second portion 52 to be positioned vertically and anteroposteriorly. The projection 52I on the top surface 52A of the second portion 52 adheres tightly to the upper horizontal wall 27M.

The front region of the fitting groove 28K in each side bottom portion 28 is deeper than the rear region (see the fitting groove 28K in the side bottom portion 28R in FIG. 2). In this regard, the engine cover 19 further includes a raised portion 63 to be attached to each side bottom portion 28 (see FIG. 17). The raised portion 63 is, for example, a hollow body, which is housed in the front region of the fitting groove 28K to raise the front region of the fitting groove 28K. This fills the gap between the outer surface 28Q of the side bottom portion 28 defining a design surface and the outer edge 18A of the mount 18.

The raised portion 63 includes a sealing surface 63A continuous with the sealing surface 52C of the second portion 52 and the bottom (not shown) of the rear region of the fitting groove 28K, and a pressing surface 63B bent from the front end of the sealing surface 63A to extend laterally outward (leftward in the case of the side bottom portion 28L) in an inclined manner. The sealing surface 63A adheres tightly to the second protrusion 43F of the third seal 43 from the left. The pressing surface 63B presses against the pressed surface 52E of the second portion 52 from the left and behind. This causes the second portion 52 to be urged so as to come close to the second protrusion 43F, according to the mutual inclination between the pressed surface 52E and the pressing surface 63B, and a reaction force from the second protrusion 43F onto the second portion 52 to be generated. Since the reaction force allows to maintain an adequate sealing margin between the sealing surface 52C and the second protrusion 43F, the sealing surface 52C and the second protrusion 43F adhere to each other very tightly.

Of the upper rib 28I and the lower rib 28J vertically sandwiching the fitting groove 28K in each side bottom portion 28, the upper rib 28I protrudes inside the engine cover 19 farther inward than the lower rib 28J to be placed on the top surface 52A of the second portion 52 (see FIG. 18). The side bottom portion 28L is attached to the front bottom portion 27 from the left. Upon this, the upper rib 28I of the side bottom portion 28L is guided by the tapered surface 52D of the second portion 52 to be placed smoothly on the top surface 52A. The projection 52I on the top surface 52A adheres tightly not only to the upper horizontal wall 27M of the fitting groove 27C in the front bottom portion 27 as mentioned above, but also to the upper rib 28I (see FIGS. 18 and 19). This causes the clearance gap between the fitting groove 27C and the fitting groove 28K to be closed by the projection 52I.

Accordingly, the boundary between the front bottom portion 27, the mount 18, and the side bottom portion 28L is sealed by both the second portion 52 and the third seal 43. It is noted that the upper horizontal wall 27M is provided with a vertical wall 27R (see also FIG. 2) with its thickness direction coinciding or substantially coinciding with the lateral direction, and the vertical wall 27R adjoins the boundary between the front bottom portion 27, the mount 18, and the side bottom portion 28L from the right. This allows the vertical wall 27R to prevent external water from entering into the engine cover 19 through the boundary as a sheet of spray.

Figure 20:
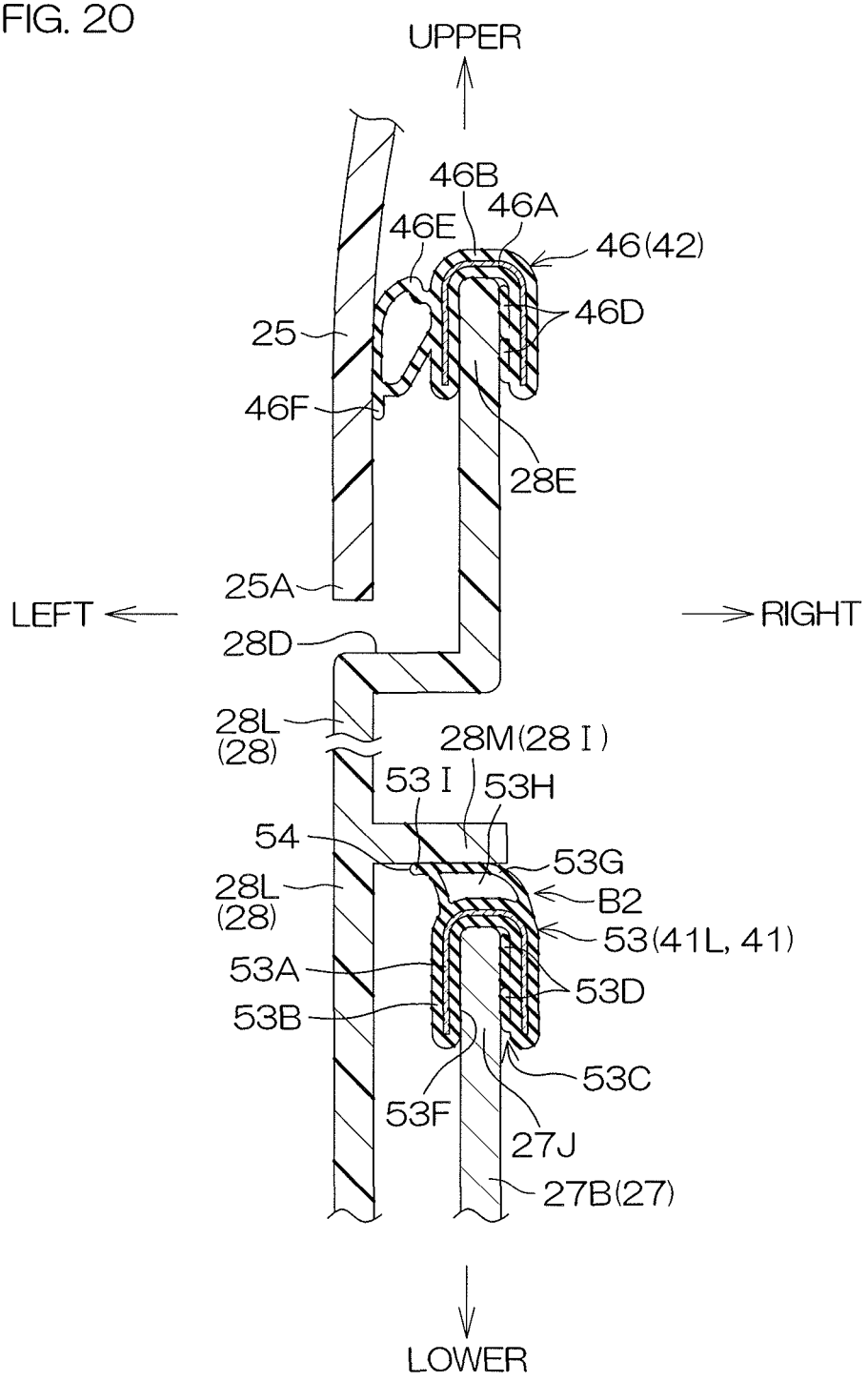
FIG. 20 is an end view of a cut portion along the line F-F in FIG. 13.

FIG. 20 is an end view of a cut portion along the line F-F in FIG. 13. As for the first seal 41L, the upper end of the left rear portion 27J of the front bottom portion 27 is fitted in the space 53C in the third portion 53 from below. In the third portion 53, the elastic portion 53B laterally sandwiches the upper end of the rear portion 27J and the first protrusion 53D is deformed in a manner following the upper end of the rear portion 27J and, in this state, laterally adheres tightly to the rear portion 27J (from the right in FIG. 20). The concavo-convex portion 53F (see also FIG. 12) of the elastic portion 53B, which is positioned opposite to the first protrusion 53D with respect to the rear portion 27J, is also compressed between the upper end of the rear portion 27J and the core portion 53A to adhere tightly to the rear portion 27J. Further, the second protrusion 53G of the third portion 53 is deformed in a manner sandwiched between the rear portion 27J and the extended section 28M of the side bottom portion 28L to adhere tightly to the extended section 28M from below. This causes the second boundary B2 between the front bottom portion 27 and the side bottom portion 28L to be sealed by the third portion 53 entirely in the front to back direction. The leading end 53I of the second protrusion 53G is continuous with the lower rib 51I of the first portion 51 and the projection 52I of the second portion 52. The first seal 41 is therefore provided with a single seal line 54 defined by the upper rib 51E, the vertical rib 51CR, and the lower rib 51I of the first portion 51, the projection 52I of the second portion 52, and the leading end 53I of the third portion 53 (see FIG. 11). The boundary between the front bottom portion 27 and the side bottom portion 28L is sealed along the seal line 54.

In accordance with the preferred embodiments described above, the engine cover 19 is divisible into three or more divided covers including the top portion 25, the front bottom portion 27, and the side bottom portions 28 (see FIG. 2). The engine cover 19 thus includes the boundary (first boundary B1) between the top portion 25, the front bottom portion 27, and the side bottom portions 28 and the boundary between the front bottom portion 27, the mount 18, and the side bottom portions 28.

The first seal 41L of the sealing structure 40 seals the boundary (first boundary B1) between the top portion 25, the front bottom portion 27, and the side bottom portion 28L with the first portion 51 (see FIGS. 14 to 16). The first seal 41L seals the boundary between the front bottom portion 27, the mount 18, and the side bottom portion 28L with the second portion 52 (see FIGS. 17 to 19). The first seal 41L seals the other boundary (the second boundary B2 between the front bottom portion 27 and the side bottom portion 28L) extending between these boundaries with the third portion 53 (see FIG. 20).

The first seal 41R of the sealing structure 40 seals the boundary (first boundary B1) between the top portion 25, the front bottom portion 27, and the side bottom portion 28R with the first portion 51 and seals the boundary between the front bottom portion 27, the mount 18, and the side bottom portion 28R with the second portion 52. The first seal 41R seals the other boundary (the second boundary B2 between the front bottom portion 27 and the side bottom portion 28R) extending between these boundaries with the third portion 53.

The second seal 42 of the sealing structure 40 provides desirable sealing characteristics at the boundary between the top portion 25 and the front bottom portion 27 and the boundary between the top portion 25 and each side bottom portion 28 (see FIG. 10). The third seal 43 of the sealing structure 40 provides desirable sealing characteristics at the boundary between the mount 18 and the front bottom portion 27 and the boundary between the mount 18 and each side bottom portion 28 (see FIG. 7). The fourth seal 44 of the sealing structure 40 seals the boundary between the pair of side bottom portions 28 (see FIG. 5).

As described heretofore, it is possible to provide desirable sealing characteristics of the divisible engine cover 19 having such a complex structure. This significantly reduces or prevents external water from entering into the engine 13 through the boundaries between the multiple divided covers in the engine cover 19.

In the first seal 41, the first portion 51 seals the clearance gap 62 between the opposing portion 27H in the upper end 27G of the front bottom portion 27 and the upper end 28E of each side bottom portion 28 with the inner portion 51A (see FIG. 14). Further, the first portion 51 seals the boundary between the outer surface of the upper end 27G of the front bottom portion 27 and the outer surface of the upper end 28E of each side bottom portion 28 with the rear edge 51M of the outer portion 51B (see FIG. 15). This provides desirable sealing characteristics at the boundary between the upper end 27G of the front bottom portion 27 and the upper end 28E of each side bottom portion 28. This significantly reduces or prevents external water from leaking through the boundary between the upper end 28E of each side bottom portion 28 and the upper end 27G of the front bottom portion 27 and entering into the engine 13.

Since the inner portion 51A is arranged in a manner offset by one step inside the engine cover 19 farther inward than the outer portion 51B, external water is less likely to reach the inner portion 51A through the boundary between the outer surface of the upper end 27G of the front bottom portion 27 and the outer surface of the upper end 28E of the side bottom portion 28. Even if external water leaks through the boundary between the outer surface of the upper end 27G of the front bottom portion 27 and the outer surface of the upper end 28E of each side bottom portion 28 and enters into the engine cover 19, the water is immediately contained in the water storage groove 51D in the inner portion 51A. It is therefore difficult for the water to reach the engine 13. This further significantly reduces or prevents water from entering into the engine 13.

The interior of the engine cover 19 has a negative pressure due to the air-intake by the engine 13. Water within the water storage groove 51D therefore tends to scatter toward the air-intake structure (not shown) upward and taken into the engine 13. However, the water within the water storage groove 51D is blocked by the upper rib 51E from scattering upward within the engine cover 19 to reach the engine 13, which further significantly reduces or prevents water from entering into the engine 13.

Water within the water storage groove 51D slides on the guide 51F (see FIG. 11) to be guided rearward by the guide 51F. This causes the water to fall out of the guide 51F to be guided into the drainage hole 27D in the engine cover 19 and/or the drainage hole 18D in the mount 18 (see FIG. 2) and eventually discharged out of the engine cover 19, which further significantly reduces or prevents water from entering into the engine 13.

Even if external water reaches the insertion hole 51G and enters the clearance gap 62 between the opposing portion 27H of the inner portion 51A of the front bottom portion 27 and each side bottom portion 28, the water is blocked by the upper rib 51E from scattering upward to reach the engine 13. Further, the water is guided by the guide 51F into the drainage hole 27D and the drainage hole 18D to be discharged out of the engine cover 19. This further significantly reduces or prevents water from entering into the engine 13.

External water may reach not the water storage groove 51D or the insertion hole 51G but the drainage groove 51K (see FIG. 11) within the inner portion 51A. In this case, water within the drainage groove 51K flows through the flow path 53H within the second protrusion 53G of the third portion 53 (see FIG. 20) to flow down through the outlet 52H of the second portion 52 (see FIG. 17) downward from the second portion 52 to be discharged through the drainage hole 27D in the engine cover 19 and/or the drainage hole 18D in the mount 18.

The second seal 42 sandwiches the upper end 51L of the outer portion 51B, which seals the boundary between the outer surface of the upper end 27G of the front bottom portion 27 and the outer surface of the upper end 28E of each side bottom portion 28 in the first seal 41, between the same and the front bottom portion 27 (see FIG. 16). This causes the first seal 41 and the second seal 42 to be continuous with each other. Since the boundary (first boundary B1) between the top portion 25, the front bottom portion 27, and each side bottom portion 28 is thus sealed by both the first seal 41 and the second seal 42, desirable sealing characteristics are provided at the boundary. This significantly reduces or prevents external water from leaking through the boundary and entering into the engine 13.

In the first seal 41, the sealing surface 52C of the second portion 52 adheres tightly to the third seal 43 from the front at the boundary between the front bottom portion 27, the mount 18, and each side bottom portion 28 to seal the boundary (see FIG. 17). This causes the first seal 41 and the third seal 43 to be continuous with each other. Since the boundary is thus sealed by both the first seal 41 and the third seal 43, desirable sealing characteristics are provided at the boundary. This significantly reduces or prevents external water from leaking through the boundary and entering into the engine 13.

The second portion 52 may be positioned laterally by the positioning groove 52F and the positioning portion 27L to seal the boundary between the front bottom portion 27, the mount 18, and each side bottom portion 28 with the lateral position being stabilized. This provides desirable sealing characteristics at the boundary and thus significantly reduces or prevents external water from leaking through the boundary and entering into the engine 13.

In the thus arranged first seal 41, the first portion 51 and the second portion 52 are preferably molded articles, while the third portion 53 is preferably an extrusion molded article, which makes it possible to achieve the structure in which the first seal 41 integrally includes the first portion 51, the second portion 52, and the third portion 53. The clearance gap at the complex first boundary B1 spanning the three portions of the top portion 25, the front bottom portion 27, and each side bottom portion 28 is filled with the first portion 51, which is a molded article. Further, the clearance gap at the complex boundary spanning the three portions of the front bottom portion 27, the mount 18, and each side bottom portion 28 is filled with the second portion 52, which is also a molded article. The clearance gap at the relatively simple second boundary B2 spanning the two portions of the front bottom portion 27 and each side bottom portion 28 is filled with the third portion 53, which is an extrusion molded article. This allows the first seal 41 to seal together the boundaries.

Although the preferred embodiments of the present invention have been described above, the present invention is not restricted to the contents of these preferred embodiments and various modifications are possible within the scope of the present invention.

For example, only one of the pair of side bottom portions 28 may be provided separately and the other side bottom portion 28 may be integral with the top portion 25 or the front bottom portion 27. In this case, only one first seal 31 may also be provided correspondingly to the separate side bottom portion 28.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a mount on which the engine is mounted;

an engine cover including a top portion opposing the engine from above, a front bottom portion located at a position lower than a position of the top portion and opposing the engine from a front of the engine, and a side bottom portion located at a position lower than the position of the top portion and rearward of the front bottom portion and opposing the engine from a side of the engine, the engine cover being coupled to the mount through the front bottom portion and the side bottom portion; and a sealing structure including a first seal integrally including a first portion that seals a boundary between the top portion, the front bottom portion, and the side bottom portion; a second portion that seals a boundary between the front bottom portion, the mount, and the side bottom portion; and a third portion extending from the first portion to the second portion and that seals a boundary between the front bottom portion and the side bottom portion.

2. The outboard motor according to claim 1, wherein the first portion is located at a position higher than a position of the second portion;

an upper end of the front bottom portion includes an opposing portion that opposes an upper end of the side bottom portion from within the engine cover;

the first portion integrally includes an inner portion at least partially located between the opposing portion and the upper end of the side bottom portion, and an outer portion extending through a boundary between an outer surface of the upper end of the front bottom portion and an outer surface of the upper end of the side bottom portion and located on the outer surface of the upper end of the front bottom portion; and the inner portion includes a water storage groove adjacent to the outer portion and opposed to the side bottom portion.

3. The outboard motor according to claim 2, wherein the inner portion includes an upper rib protruding toward the upper end of the side bottom portion and extending rearward from an upper end of the water storage groove.

4. The outboard motor according to claim 3, wherein a drainage hole is provided in a lower portion of the engine cover or the mount; and the inner portion includes a guide extending rearward from a lower end of the water storage groove to guide water within the water storage groove to the drainage hole.

5. The outboard motor according to claim 4, wherein an insertion hole, through which a fastening member is inserted to couple the opposing portion and the side bottom portion, penetrates a portion of the inner portion that is between the upper rib and the guide.

6. The outboard motor according to claim 2, wherein the sealing structure further includes a second seal that seals a boundary between the top portion and the front bottom portion and a boundary between the top portion and the side bottom portion; and the second seal surrounds a portion of the outer portion between the second seal and the front bottom portion.

7. The outboard motor according to claim 1, wherein the sealing structure further includes a third seal that seals a boundary between the mount and the front bottom portion and a boundary between the mount and the side bottom portion; and the second portion includes a sealing surface adhered to the third seal from the front of the engine at the boundary between the front bottom portion, the mount, and the side bottom portion.

8. The outboard motor according to claim 1, wherein the second portion includes a longitudinally extending positioning groove; and the front bottom portion includes a positioning portion fitted into the positioning groove.

9. The outboard motor according to claim 1, wherein the first portion and the second portion are molded, and the third portion is extrusion molded.

10. The outboard motor according to claim 1, wherein the side bottom portion includes a left side bottom portion and a right side bottom portion opposing the engine from a left and a right of the engine, respectively;

the sealing structure includes a left first seal and a right first seal; and the sealing structure further includes a fourth seal that seals a boundary between the left side bottom portion and the right side bottom portion.

11. A sealing structure for an engine cover of an outboard motor including an engine and a mount on which the engine is mounted, wherein the engine cover covers the engine and includes a top portion opposing the engine from above, a front bottom portion located at a position lower than a position of the top portion and opposing the engine from a front of the engine, and a side bottom portion located at a position lower than the position of the top portion and rearward of the front bottom portion and opposing the engine from a side of the engine, and the engine cover is coupled to the mount through the front bottom portion and the side bottom portion, the sealing structure comprising:

a first seal integrally including:

a first portion that seals a boundary between the top portion, the front bottom portion, and the side bottom portion;

a second portion that seals a boundary between the front bottom portion, the mount, and the side bottom portion; and a third portion extending from the first portion to the second portion and that seals a boundary between the front bottom portion and the side bottom portion.

12. The sealing structure according to claim 11, wherein the first portion is located at a position higher than a position of the second portion;

the first portion integrally includes an inner portion at least partially located between an opposing portion opposing an upper end of the side bottom portion from within the engine cover in an upper end of the front bottom portion and the upper end of the side bottom portion, and an outer portion extending through a boundary between an outer surface of the upper end of the front bottom portion and an outer surface of the upper end of the side bottom portion and located on the outer surface of the upper end of the front bottom portion, and the inner portion includes a water storage groove adjacent to the outer portion and opposing the side bottom portion.

13. The sealing structure according to claim 12, wherein the inner portion includes an upper rib protruding toward the upper end of the side bottom portion and extending rearward from an upper end of the water storage groove.

14. The sealing structure according to claim 13, wherein the inner portion includes a guide extending rearward from a lower end of the water storage groove to guide water within the water storage groove to a drainage hole in a lower portion of the engine cover or the mount.

15. The sealing structure according to claim 14, wherein an insertion hole, through which a fastening member is inserted to couple the opposing portion and the side bottom portion, penetrates a portion of the inner portion located between the upper rib and the guide.

16. The sealing structure according to claim 12, further comprising a second seal that seals a boundary between the top portion and the front bottom portion and a boundary between the top portion and the side bottom portion, wherein the second seal surrounds a portion of the outer portion located between the second seal and the front bottom portion.

17. The sealing structure according to claim 11, further comprising a third seal that seals a boundary between the mount and the front bottom portion and a boundary between the mount and the side bottom portion; wherein the second portion includes a sealing surface adhered to the third seal from the front of the engine at the boundary between the front bottom portion, the mount, and the side bottom portion.

18. The sealing structure according to claim 11, wherein the first portion and the second portion are molded, and the third portion is extrusion molded.

19. An outboard motor comprising:

an engine;

an engine cover including a first cover, a second cover, and a third cover, the engine cover covering the engine and including a first boundary spanning three portions of the first cover, the second cover, and the third cover and a second boundary between two of the three portions and continuous with the first boundary; and a seal integrally including a three-part seal that seals the first boundary and a two-part seal having a structure different from that of the three-part seal and that seals the second boundary.

20. The outboard motor according to claim 19, wherein the three-part seal is molded, and the two-part seal is extrusion molded.

* * * * *